US009352578B2

(12) United States Patent
Ma et al.

(10) Patent No.: US 9,352,578 B2
(45) Date of Patent: May 31, 2016

(54) METHOD FOR CONTROLLING LIGHT EMISSION OF INK CARTRIDGE AND CONTROL UNIT, CIRCUIT BOARD, INK CARTRIDGE, AND IMAGING DEVICE

(71) Applicant: ZHUHAI NINESTAR MANAGEMENT CO., LTD., Zhuhai (CN)

(72) Inventors: Haoming Ma, Zhuhai (CN); Zhizheng Jia, Zhuhai (CN); Xuejin Sun, Zhuhai (CN)

(73) Assignee: ZHUHAI NINESTAR MANAGEMENT CO., LTD., Zhuhai (CN)

( * ) Notice: Subject to any disclaimer, the term of this patent is extended or adjusted under 35 U.S.C. 154(b) by 0 days.

(21) Appl. No.: 14/697,515

(22) Filed: Apr. 27, 2015

(65) Prior Publication Data

US 2015/0239252 A1 Aug. 27, 2015

Related U.S. Application Data

(63) Continuation of application No. PCT/CN2013/072356, filed on Mar. 8, 2013.

(30) Foreign Application Priority Data

Oct. 26, 2012 (CN) ..... 2012 1 0418910
Oct. 26, 2012 (CN) ..... 2012 1 0422548

(51) Int. Cl.
*B41J 2/175* (2006.01)
*B41J 29/38* (2006.01)

(52) U.S. Cl.
CPC ..... *B41J 2/17543* (2013.01); *B41J 2/1752* (2013.01); *B41J 2/1753* (2013.01); *B41J 2/1755* (2013.01); *B41J 2/17513* (2013.01); *B41J 2/17546* (2013.01); *B41J 2/17553* (2013.01); *B41J 2/17566* (2013.01); *B41J 29/38* (2013.01); *B41J 2002/17573* (2013.01)

(58) Field of Classification Search
CPC .. B41J 2/17543; B41J 2/17546; B41J 2/1755; B41J 2/1752
See application file for complete search history.

(56) References Cited

U.S. PATENT DOCUMENTS 7,527,344 B2 * 5/2009 Kitagawa et al. ..... 347/7

* cited by examiner

*Primary Examiner* — Justin Seo
(74) *Attorney, Agent, or Firm* — J.C. Patents

(57) ABSTRACT

The present invention provides a method for controlling light emission of an ink cartridge, a control unit, a circuit board, an ink cartridge and an imaging device, to decrease misjudgment rate of the imaging device. The control method includes: receiving and identifying a light emitting control instruction from the imaging device main body; starting a light-on delay timing when identifying the light emitting control instruction is a light-on instruction; controlling the light emitting unit of the ink cartridge to stop emitting light when identifying the light emitting control instruction is a light-off instruction; controlling the light emitting unit to emit light when detecting a timing value of the light-on delay timing reaches a delay threshold value. The present invention avoids misjudgment problem of unable to pass position detection due to light amount inconsistent caused by manufacturing errors of the light emitting unit, when setting a light-on delay timing.

20 Claims, 14 Drawing Sheets

METHOD FOR CONTROLLING LIGHT EMISSION OF INK CARTRIDGE AND CONTROL UNIT, CIRCUIT BOARD, INK CARTRIDGE, AND IMAGING DEVICE

CROSS-REFERENCE TO RELATED APPLICATIONS

This application is a continuation of International Patent Application No. PCT/CN2013/072356, filed on Mar. 8, 2013, which claims priority to Chinese Patent Applications No. 201210422548.6 and No. 201210418910.2, filed on Oct. 26, 2012, all of which are hereby incorporated by reference in their entireties.

FIELD OF THE INVENTION

The present invention relates to imaging device controlling technologies and, in particular, to a method for controlling light emission of an ink cartridge and a control unit, a circuit board, an ink cartridge, and an imaging device.

BACKGROUND

Imaging device, such as printer, copier, and fax machine, is a common instrument in people's daily work and life. The structure of an imaging device is substantially divided into two parts, that is, an imaging device main body and ink cartridge(s). The ink cartridge is an easy-consumed product, so it can usually be detachably mounted in the imaging device main body and is easy to be replaced.

A plurality of ink cartridges can be arranged in a conventional imaging device, for a long time usage, or may be provided with different colors. In order to ensure correct mounting positions of the respective ink cartridge, an ink cartridge position detecting technology is introduced.

Ink cartridge position detection may be implemented according to light emitting and receiving. In prior art, a light source is generally disposed on the ink cartridge, while a light receiver is disposed on the main body of the imaging device. When detecting a position of an ink cartridge, the position of the ink cartridge is facing the light receiver, and then the light source of the ink cartridge is controlled to emit light. The light receiver receives the light, detects and records light emitting quantity. Then, the adjacent ink cartridge is controlled to emit light, and the light receiver receives the light, detects and records light emitting quantity. Since the receiver is directly facing the ink cartridge to be detected, the light emitting quantity received from the ink cartridge to be detected is greater than that of the adjacent ink cartridge, and the light emitting quantity of the ink cartridge to be detected will be greater than a predetermined threshold value. Accordingly, the main body of the imaging device can identify that the position of the ink cartridge to be detected is correct. The detecting method of the other ink cartridges is same.

However, the aforesaid detecting method has some defects: manufacturing errors inevitably exist in actual manufacturing process of the light source, therefore, the light emitting amount of each light source on each one of the ink cartridges cannot be strictly kept equivalent, so that the light emitting quantity of the adjacent ink cartridge may be equal to or greater than the ink cartridge to be detected, which will result in incorrect results of ink cartridge positions, thereby increasing misjudgment rate of the imaging device.

SUMMARY

The embodiments of the present invention provide a method for controlling light emission of an ink cartridge and a control unit, a circuit board, a ink cartridge, and an imaging device, to decrease misjudgment rate of an imaging device.

One aspect of the present invention provides a method for controlling light emission of an ink cartridge. A ink cartridge is detachablely mounted on a main body of an imaging device, and the ink cartridge includes an interface unit used for receiving signals transmitted by the main body of the imaging device, a storage unit used for storing relevant information of the ink cartridge, a light emitting unit for emitting light to a light receiving unit disposed on the main body of the imaging device, and a control unit for controlling the light emitting unit to emit light, and at least two ink cartridges are arranged on the main body of the imaging device. The method includes:

receiving and identifying, by the control unit, a light emitting control instruction from the main body of the imaging device;

starting, by the control unit, a light-on delay timing when identifying that the light emitting control instruction is a light-on instruction;

the control unit controlling the light emitting unit of the ink cartridge to stop emitting light when identifying the light emitting control instruction is a light off command;

controlling, by the control unit, the light emitting unit to emit light when detecting that a timing value of the light-on delay timing reaches a delay threshold value;

the delay threshold value is greater than the adjacent detection time period, which is a time interval for an adjacent position detection of the ink cartridge to be detected by the main body of the imaging device, and is less than the facing detection time period, which is a time interval for a facing position detection of the ink cartridge to be detected by the main body of the imaging device.

Another aspect of the present invention provides a control unit for controlling light emission of an ink cartridge. The control unit is disposed on an ink cartridge which is detachably installed in the main body of the imaging device, and the main body of the imaging device has a light receiver. The ink cartridge includes an interface unit for receiving signals transmitted from the main body of the imaging device, a storage unit for storing relevant information of the ink cartridge, and a light emitting unit for emitting light to the light receiver disposed on the main body of the imaging device. And, at least two ink cartridges are arranged on the main body of the imaging device. The control unit includes:

an instruction identifying module, configured to receive and identify a light emitting control instruction from the main body of the imaging device;

a light-on delay module, configured to start a light-on delay timing when identifying that the light emitting control instruction is a light-on instruction;

a extinguishing module, configured to control the light emitting unit on the ink cartridge to stop emitting light when identifying that the light emitting control instruction is a light-off instruction;

an illuminating module, configured to control the light emitting unit on the ink cartridge to emit light when detecting that a timing value of the light-on delay timing reaches a delay threshold value.

The delay threshold value is greater than the adjacent detection time period, which is a time interval for an adjacent position detection of the ink cartridge to be detected by the main body of the imaging device, and is less than the facing detection time period, which is a time interval for a facing position detection of the ink cartridge to be detected by the main body of the imaging device.

Another aspect of the present invention provides a control circuit board for controlling light emission of an ink cartridge. The control circuit board includes an interface unit, a storage unit, and a control unit. The interface unit is configured to receive signals transmitted by the main body of the imaging device. The storage unit is configured to store relevant information of the ink cartridge. The interface unit and the storing unit are respectively connected to the control unit. The control unit is the control unit for controlling ink cartridge light emission provided in any embodiment of the present invention.

Another aspect of the present invention provides an ink cartridge. The ink cartridge includes a main body of an ink cartridge, and further includes the circuit board for controlling light emission of the ink cartridge provided in any embodiment of the present invention.

Another aspect of the present invention provides an imaging device. The imaging device includes a main body of an imaging device and at least two ink cartridges. The main body of the imaging device includes at least a light receiver, a carriage, and a position detection module. The at least two ink cartridges are fixedly mounted on the carriage. The carriage is movably disposed relative to the light receiver.

the ink cartridges are the ink cartridges provided in any embodiment of the present invention;

the interface unit of each ink cartridge is connected to an instruction output terminal of the main body of the imaging device via a common line;

the position detection module includes:

a moving control unit, configured to control the carriage to move to a position where a ink cartridge to be detected is facing the light receiver;

a light emitting control unit, configured to control the light emitting unit of the ink cartridge to emit light in a facing detection time period of a facing position detection and an adjacent detection time period of an adjacent position detection of the ink cartridge to be detect by transmitting light emitting control instructions to the ink cartridges; and a light amount detection unit, configured to, when identifying that a first light amount received in the facing detection time period is greater than a first preset light amount, and a second light amount received in the adjacent detection time period is less than the first light amount, or when identifying that a third light amount received in the facing detection time period is greater than a third preset light amount, determine that the position of the ink cartridge to be detected is correct.

The solution of the present embodiment, by setting a delay time for the light-on instruction of different ink cartridges, and the delay time is less than the time period of the facing position detection, and is greater than the time period of the adjacent position detection, that is equivalent to let the ink cartridges not emit light in the adjacent position detection stage, which guarantees that the light amount of the adjacent position detection stage is less than the light amount of the facing position detection stage, thus avoiding the misjudgment problem of unable to pass the position detection due to the light amount inconsistent caused by manufacturing errors of the ink cartridge light emitting unit.

DESCRIPTION OF EMBODIMENTS

In order to make the purposes, technical solutions, and advantages of the present invention clearer, the present invention will be further described clearly and comprehensively with reference to the accompanying drawings and embodiments. Obviously, the described embodiments are a part of embodiments of the embodiment, but not all embodiments. The embodiments provided for the present invention, and all other embodiments obtained by an ordinary person skilled in the art without creative work, all belong to the protection scope of the present invention.

For describing the solutions clearly, a typical ink cartridge and a connection structure between the typical ink cartridge and an imaging device main body are introduced first. A person skilled in the art should understand that, the embodiments of the present invention may adapt for the ink cartridge, but are not restricted to the ink cartridge structure shown in the figures.

Figure 1A:
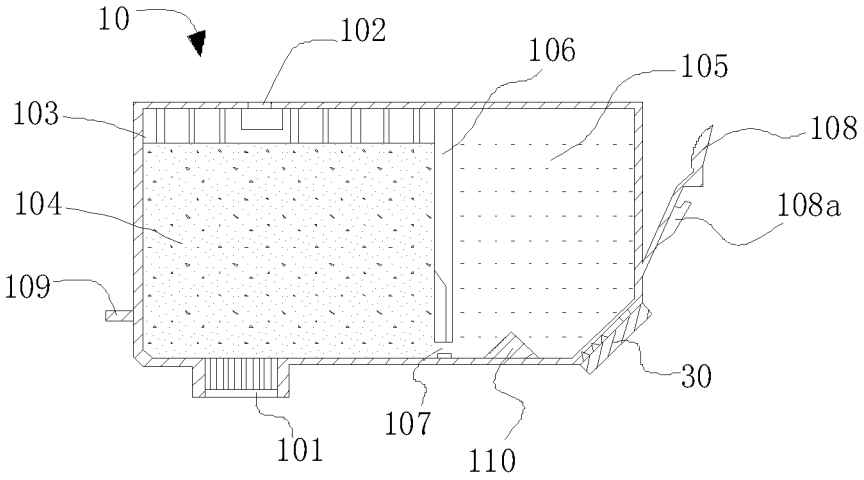
FIG. 1*a* is a schematic structural diagram of an ink cartridge adapted for embodiments of the present invention.

FIG. 1*a* is a schematic structural diagram of an ink cartridge adapted for embodiments of the present invention; FIG.

Figure 1B:
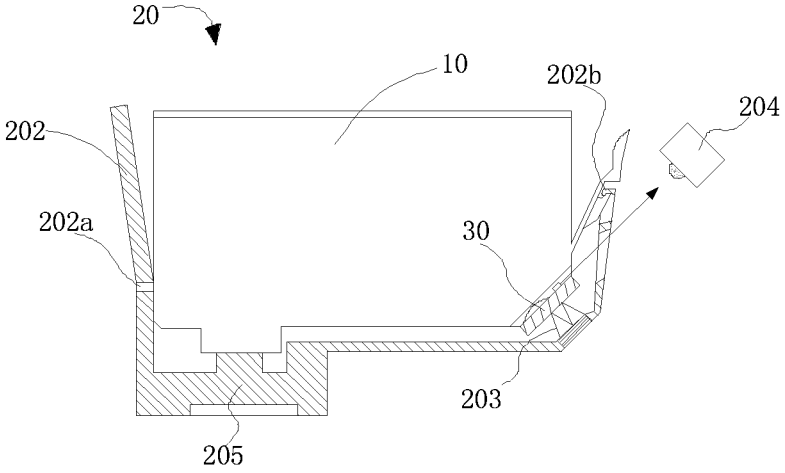
FIG. 1*b* is a schematic structural diagram of the ink cartridge shown in FIG. 1*a* mounted in the main body of an imaging device.
Figure 1C:
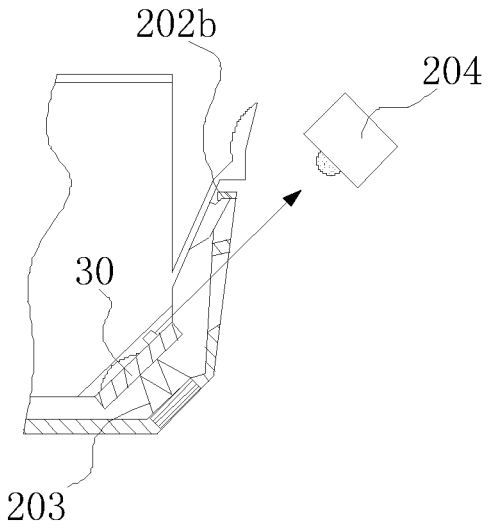
FIG. 1*c* is an partial enlarged schematic view of FIG. 1*b;*

1*b* is a schematic structural diagram of the ink cartridge shown in FIG. 1*a* mounted in a main body of an imaging device. The imaging device described is taken an inkjet printer as an example. FIG. 1*c* is a partial enlarged schematic view of FIG. 1*b*.

As shown in FIG. 1*a*, an ink cartridge 10 includes a housing and a cover, which are made of plastic material, the two parts are integrated as a whole by thermo-fusion welding or friction welding, thereby a chamber is formed in the interior thereof. The chamber of the ink cartridge 10 is divided into a negative pressure cavity 103 and an ink cavity 105 by a partition wall 106. The two cavities communicate with each other via a through hole 107 below the partition wall 106. The ink cavity 105 accommodates ink for supplying to the printer. Negative pressure generating component, such as porous body etc., is disposed in the negative pressure cavity 103 to control back pressure in the interior of the ink cartridge 10. The above porous body preferably is sponge 104. A person skill in the art should understand, the negative pressure generating component may also be other valve members for controlling ink flow or air flow, which can be selected according to specific using characteristic of the ink cartridge; furthermore, the inner chamber of the ink cartridge also can be configured as other structures according to specific requirement, and is not limited to the above separated structure. As shown in FIG. 1*b*, the ink cartridge 10 is detachablely mounted on an inkjet printer 20. A support member 108 capable of pivoting about a support point of a rear sidewall is disposed on the ink cartridge 10. The support member 108 is formed of resin material and is integratedly molded with the housing of the ink cartridge 10. Furthermore, a first engagement portion 109 and a second engagement portion 108*a* are respectively formed on a front sidewall and a rear sidewall of the ink cartridge 10. They can respectively engage with lock structures 202*a* and 202*b* of a printer to insure the ink cartridge 10 firmly mounted on the printer, and the second engagement portion 108*a* is integratedly formed with the support member 108.

Additionally, as shown in FIG. 1*a*, a bottom surface of the ink cartridge 10 is provided with an ink outlet 101 for supplying ink to the printer. As shown in FIG. 1*b*, when mounted on the printer 20, the ink cartridge 10 is connected with a printer head 205; and, an air inlet 102 is provided above the negative pressure cavity 103 of the ink cartridge, for connecting the interior of the ink cartridge 10 to the air outside. Furthermore, as shown in the figures, a prism 110 configured to detect remaining ink amount of the ink cartridge 10 is disposed on the bottom of the ink cavity 105. This is a common technology in the art, and will not be described in detail here. The above structure is the main body of the ink cartridge. In addition, the ink cartridge also includes a chip 30.

Besides a plurality of the aforesaid ink cartridges, the inkjet printer further includes the following components: a carriage, which moves back and forth along a paper recording direction and is disposed on the inkjet printer 20 to accommodate the ink cartridge 10, an ink cartridge installing part 202 secured on the carriage to accommodate the ink cartridges 10 a plurality of device-side electrical contacts 203 respectively corresponding to the ink cartridges 10, a light receiver 204 for receiving light, a circuit (not shown in the figures) connected with a line which is commonly connected to the plurality of device electrical contacts 203, and a control circuit (not shown in the figures) configured to judge whether the ink cartridge 10 is mounted in a correct position according to a receiving result of the light receiver 204. Obviously, the plurality of device electrical contacts 203 are connected commonly with one line. Therefore after mounting on the printer 20, the plurality of ink cartridges 10 are in a bus connection state.

Figure 2A:
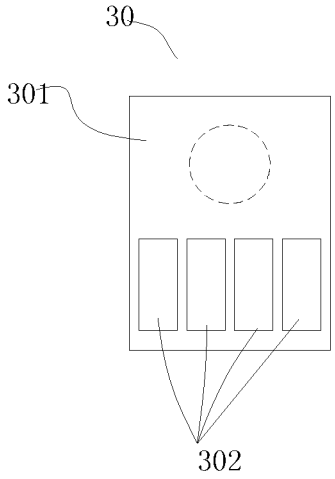
FIG. 2*a* is a schematic front view of an ink cartridge chip in FIG. 1*a;*
Figure 2B:
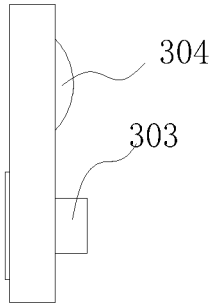
FIG. 2*b* is a schematic side view of the ink cartridge chip in FIG. 1*a;*

Additionally, as shown in FIG. 1*a* and FIG. 2*b*, except the main body of the ink cartridge, a chip 30 is disposed on a corner which connects the bottom wall and the rear sidewall of the ink cartridge 10. FIG. 2*a* and FIG. 2*b* are schematic structural views of the ink cartridge chip in FIG. 1*a*. As shown in FIG. 2*a* and FIG. 2*b*, the chip 30 includes: a circuit board 301, configured to carry all kinds of components described as below: ink cartridge side electrical contacts 302, a light emitting unit 303, a storing unit and a control unit 304. The control unit 304 may be a controller, and the storing unit could be integrated in the controller or arranged individually.

A plurality of ink cartridge side electrical contacts 302 are formed on the circuit board 301, and can be correspondingly connected to the device-side electrical contacts 203 so as to establish electrical connection between the printer 20 and the ink cartridge 10 for information communication. Specifically, the plurality of ink cartridge side electrical contacts 302 include power contacts for applying a voltage applied by the printer side to the chip 30, and data contacts for inputting/outputting data to the printer 20, etc. The light emitting unit 303, as shown in FIG. 1*c*, emits light to the light receiver 204. Preferably, in the following embodiments, it is a light emitting diode (Light Emitting Diode, LED). The storing unit is disposed on the circuit board 301 for storing all kinds of relevant information of the ink cartridge 10, such as ink amount, ink cartridge type, ink color, and ink cartridge manufacturing date, etc., and also including ink cartridge identifying information therein. The storing unit can be selected to be all kinds of memories such as electrically erasable programmable read-only memory (Electrically Erasable Programmable Read-Only Memory, EEPROM), and random access memory (Random Access Memory, RAM) etc. In the present embodiment, the control unit 304 is a controller, as shown in FIG. 2*b*, and is mainly configured to control the light emitting unit 303 according to control command from the printer inputted by the plurality of ink cartridge side electrical contacts 302.

Persons of ordinary skill in the art shall understand that, the above light emitting unit also may be configured as incandescent lamp or other components capable of emitting light. The LED light can emit light with different wavelength according to different design requirements, such as visible light and invisible light. In the present embodiment, for providing indication function to users, preferably, the LED emits visible light.

Additionally, the ink cartridge 10 is further adhered with labels (not shown) that indicate the ink cartridge type and ink color, and each ink cartridge accommodation cavity of the ink cartridge installing part 202 of the printer 20 is adhered with color label correspondent with the ink color of the cartridge should be mounted on. For this reason, when installing, the user only needs to compare the color identification of the ink cartridge labels with color marks in the color labels in the ink cartridge install part 202 of the printer 20, then, the proper ink cartridges can thus be installed in correct positions.

The present embodiment can be used in an imaging device with ink cartridge position detection function. Taking an inkjet printer for example, a typical position detection solution provided in the printer is as below.

Figure 3A:
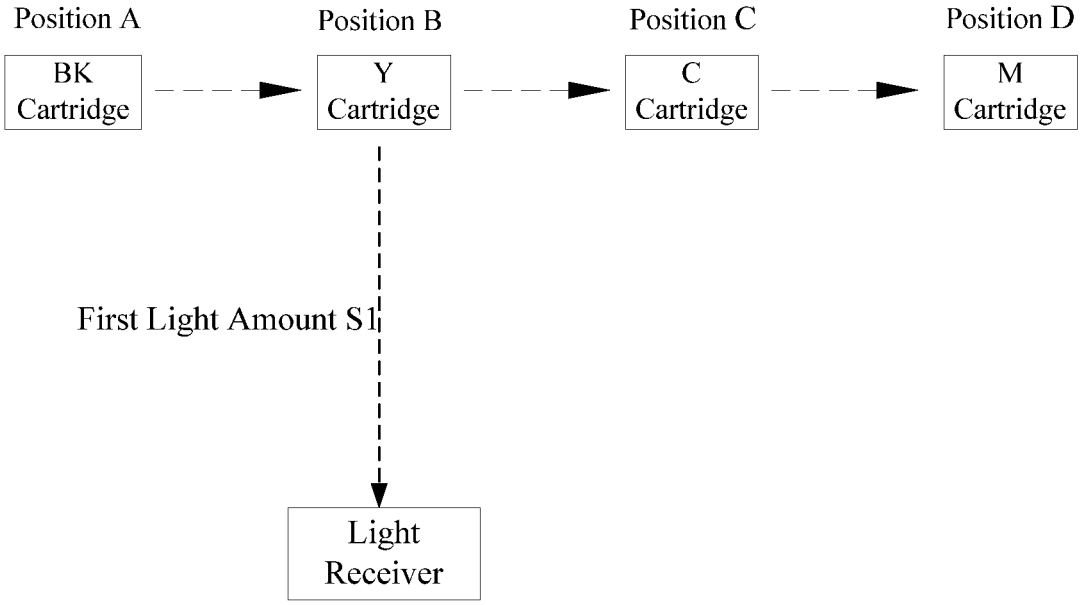
FIGS. 3*a* and 3*b* are schematic diagrams showing the detection principle related to ink cartridge positions adapted for embodiments of the present invention.
Figure 3B:
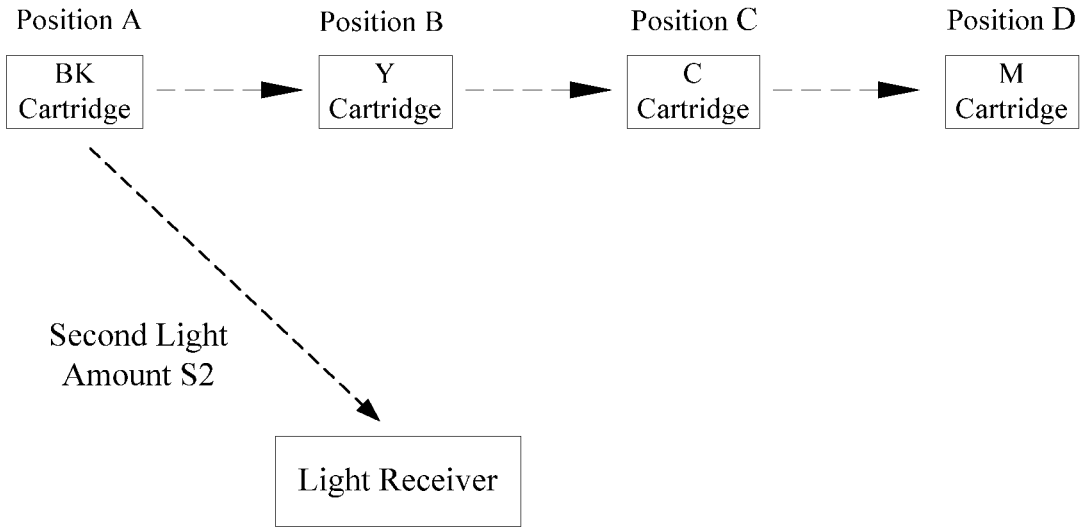

For ensuring the inkjet printer to print normally and avoiding the printing deflection caused by installing the ink cartridges in wrong positions, it is generally needed to detect whether the ink cartridges are installed in proper positions after the ink cartridges installed in the printer. FIG. 3*a* and FIG. 3*b* are schematic diagrams showing the detection principle of the ink cartridge position. As shown in FIG. 3*a*, assuming that the inkjet printer has four ink cartridges distinguished via color identifications for clearly distinguishing. They are marked as black ink cartridge BK, yellow ink cartridge Y, cyan ink cartridge C, magenta ink cartridge M. Each ink cartridge is respectively installed in a corresponding ink cartridge installation position, and the respective correct installation position of each ink cartridge is A, B, C, and D as shown in FIG. 3*a*. The light receiver is disposed on the inkjet printer with a fixed position, and the relative position between the light emitting unit in each ink cartridge and the light receiver in the printer is changed by moving the carriage to shift the ink cartridge positions.

Position detection processing for each ink cartridge mainly includes two parts: facing position detection of the ink cartridge currently to be detected and adjacent position detection of the adjacent ink cartridge. And every ink cartridge of the imaging device need to be considered as an ink cartridge to be detected and then the plurality of cartridges are detected one by one. The facing position detection means a process in which: the printer actuates the light emitting unit of the ink cartridge to be detected facing to the light receiver to emit light, and detects whether the light amount received by the light receiver is greater than a preset value; and the adjacent position detection means a process in which: maintaining the ink cartridge to be detected at a position facing to the light receiver, the printer actuates a light emitting unit of any ink cartridge adjacent to the ink cartridge to be detected to emit light, and detects whether the light amount received by the light receiver at this time is less than the light amount received during the facing position detection. As shown in FIG. 3*a*, for the ink cartridge Y to be detected, the ink cartridge Y will be moved to a position directly facing to the light receiver, the light emitting unit of the ink cartridge Y to be detected is controlled to emit light, then, the light receiver receives light and obtains a first light amount S1 and judge whether the first light amount S1 is greater than a preset threshold value or not. If yes, the facing position detection of the ink cartridge to be detected is correct. As shown in FIG. 3*b*, the position of the ink cartridge Y to be detected is kept unchanged, and the light emitting unit of the ink cartridge BK adjacent to the ink cartridge Y to be detected is controlled to emit light. The light receiver receives light and obtains a second light amount S2, and judges whether the first light amount S1 is greater than the second light amount S2. If yes, the adjacent light detection of the ink cartridge Y to be detected is correct. Otherwise, it is determined that the facing position detection or the adjacent light detection is wrong. The position of the ink cartridge to be detected can be considered as correct only when the result of the two detection processes is positive. In the above description, the ink cartridge to be detected should be understood as any ink cartridge would carry out the facing position detection, and the adjacent ink cartridge should be understood as any ink cartridge adjacent to the ink cartridge to be detected.

In order to meet the requirement of the ink cartridge position detection of the imaging device without changing the configuration of the imaging device, and also be compatible with position deviation or light amount deviation, decrease misjudgment rate of position detection, the present embodiment provides several solutions as follows.

Embodiment One

Figure 4A:
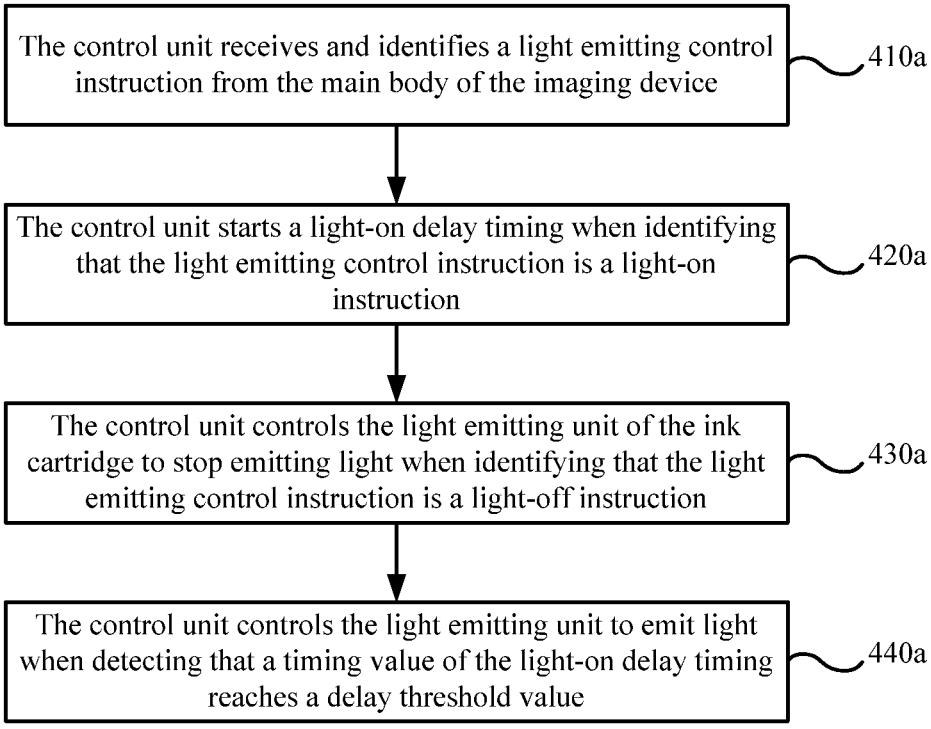
FIG. 4*a* is a schematic flow chart of a method for controlling light emission of the ink cartridge according to the first embodiment of the present invention.

FIG. 4*a* is a schematic flow chart of a method for controlling light emission of an ink cartridge according to the first embodiment of the present invention. The control method is adapted for the following ink cartridges. Referring to FIG. 1*a*-FIG. 1*c* and FIG. 2*a*-FIG. 2*b*, the ink cartridge is detachably mounted on the main body of the imaging device, and the ink cartridge includes an interface unit for receiving signal transmitted by the main body of the imaging device, a storing unit for storing information relative to the ink cartridge, a light emitting unit for emitting light to the light receiver disposed on the main body of the imaging device, and a control unit for controlling the light emitting unit to emit light. The main body of the imaging device includes at least two ink cartridges. The control method of the present embodiment can be executed by the control unit of the ink cartridge. If the imaging device has a plurality of ink cartridges, the control unit in any of the ink cartridges can execute the method of the present embodiment. The method specifically includes the following steps:

Step 410*a*: the control unit receives and identifies a light emitting control instruction from the main body of the imaging device;

Step 420*a*: the control unit starts a light-on delay timing when identifying that the light emitting control instruction is a light-on instruction.

In this step, the light-on delay timing can be first time started, or can be restarted after resetting a timer which has already been started.

Step 430*a*: the control unit controls the light emitting unit of the ink cartridge to stop emitting light when identifying that the light emitting control instruction is a light-off instruction;

Step 440*a*: the control unit controls the light emitting unit to emit light when detecting that a timing value of the light-on delay timing reaches a delay threshold value;

A time interval for detecting facing position of the ink cartridge to be detected by the main body of the imaging device is a facing detection time period, a time interval for detecting adjacent position of the ink cartridge to be detected is an adjacent detection time period, the delay threshold value t is greater than the adjacent detection time period, and less than the facing detection time period.

In the present embodiment, the facing detection time period is denoted as a first time period T1, and the adjacent detection time period is denoted as a second time period T2, thus the delay threshold value t is greater than the second time period T2, and is less than the first time period T1.

In actual practice, each control unit of the ink cartridge can execute a same delay operation, and also can execute different delay operations. The above operations may be executed by a part of or all of the plurality of ink cartridges.

Control content of the light emitting control instruction from the main body of the imaging device are mainly classified into two types, that is, a light-on instruction and a light-off instruction. In position detection technology of the imaging device, the light-on instruction and the light-off instruction will be transmitted to the corresponding ink cartridges successively when performing the facing position detection and the adjacent position detection, with the aim to control the light emitting unit of the ink cartridge 1 to emit light in a determined time period for position detection.

In actual practice, the light emitting control instruction cooperates with movement control of the ink cartridge. For example, one situation is the printer will transmit the light-on instruction and the light-off instruction in pair during the time period of the facing position detection and the time period of the adjacent position detection individually to the control unit of the cartridge for controlling the light emit unit, when the cartridge is moved to the facing position in the control process of light emission. Thus, in the present embodiment, the above first time period T1 is a time interval between the light-on instruction transmitted by the printer and the light-off instruction transmitted by the printer during the facing position detection of the ink cartridge to be detected. The second time period T2 is a time interval between the light-on instruction transmitted by the printer and the light-off instruction transmitted by the printer during the adjacent position detection of the ink cartridge to be detected. Generally, the first time period T1 is greater than the second time period T2.

In another situation, if a specific ink cartridge needs to emit light as an adjacent ink cartridge of other ink cartridges, and further needs to emit light as an ink cartridge to be detected for the facing position detection, while the aforesaid two light emitting control operation are continuous. Then, only one group of light-on instruction and light-off instruction need to be transmitted to let the ink cartridge always emit light. That is, the light emitting control instructions in the facing position detection stage and the adjacent position detection stage are merged. The time period is at least equal to a sum of the first time period T1 and the second time period T2. For this situation, the first time period T1 refers to a time period between the light-on instruction and the light receiver receiving the light amount of the facing position detection, the second time period T2 means a time period between light receiver receiving light amount of adjacent position detection and the light-off instruction. Or, the second time T2 refers to the time period between the light-on instruction and the light receiver receiving the light amount of the facing position detection, the first time T1 refers to the time period between the light receiver receiving the light amount of adjacent position detection and the light-off instruction. When does the light receiver begin to receive the light amount of the facing position detection and the light amount of the adjacent position detection is controlled by the main body of the imaging device.

If the light emitting control instructions of the facing position detection and the adjacent position detection sent by the main body of the imaging device for the ink cartridge to be detected are mutually independent, then the order of the facing position detection and the adjacent position detection of each ink cartridge to be detected is not limited. If as the aforesaid, the light emitting control instruction of the facing position detection and of the adjacent position detection of the ink cartridge to be detected can be merged, the present embodiment is adapted for the situations of the adjacent position detection being executed after or before the facing position detection. Each ink cartridge does not need to distinguish whether the light-on instruction and the light-off instruction are used in facing position detection or in the adjacent position detection.

In the present embodiment, the ink cartridge controls to emit light after delaying a predetermined delay time for the received light-on instruction. If the light-off instruction is received when the delay time is not reached, then the ink cartridge is directly controlled not to emit light; if the light-off instruction is not received when the delay time is reached, then the ink cartridge is controlled to emit light. Since the delay time t is greater than the second time period T2, that is: in the time period of the adjacent position detection, the light emitting unit does not emit light due to the delay, and in the time period of the facing position detection, there is at least T1-t light-on time after delaying a specific time for detection.

A detection result of the light receiver in the main body side of the imaging device is: in T1 time period, light is still received with a first light amount, according to this, it is detected that the facing position detection is correct. In T2 time period, light will not be received, the light amount is zero, and is inevitably less than the first light amount, according to this, it can be judged that the adjacent position detection is correct.

Since an imaging device will be installed with a plurality of ink cartridges, the corresponding facing detection time period of the different ink cartridges which are considered as ink cartridges to be detected may be the same or different, and the corresponding adjacent detection time period also may be the same or different. If in a different situation, a preferred delay threshold value configured for the control unit of each ink cartridge is greater than the greatest adjacent detection time period of the imaging device, and is less than the smallest facing detection time period; if in a same situation, the delay threshold value configured for the control unit of each ink cartridge may just satisfy the above rules of "greater than the adjacent detection time period and less than the facing detection time period". Furthermore, the delay threshold value configured for the control units of different ink cartridges may be the same with or different from each other. In other words, a plurality of delay threshold values can be preset in the storing unit, then different delay threshold values can be adopted randomly.

A preferred delay threshold value t configured for the control unit of each ink cartridge is set according to its first time period T1 and second time period T2 when it is considered as the ink cartridge to be detected. The preferred value range is that, when the first time period is 300 ms to 2 s, and the second time period is 1 ms to 100 ms, then the preferred delay threshold value is 200 ms.

When a next received instruction is also a light-on instruction after received a light-on instruction, and the light-on delay timing started by the previous light-on instruction hasn't been stopped or reset, the control unit can reset the started timer and then restart, and when executing a second light-on delay timing after restarting, the delay threshold value t2 corresponding to the second light-on delay timing may be the same with or different from the delay threshold value t. That is, a plurality of delay threshold values can be preset in the storing unit, different delay threshold values are randomly adopted, or invoked based on the times of receiving the light-on instruction counted.

For a situation that the time interval T11 between the light-off instruction and a next light-on instruction is relatively short, that is, the timing threshold value t of the light-on delay is greater than a sum of the second time period T2 and the time interval T11, the light-on delay timing may not be dealt with after receiving the light-off instruction, but clean or reset the light-on delay timer for re-timing till a next light-on instruction is received. Preferably, when the control unit identifies that the light emitting control instruction is a light-off instruction, it stops the light-on delay timing, or resets the light-on delay timing, so as to guarantee that the light emitting unit will not emit light due to arrival of the delay time.

Additionally, after the control unit identifies that the light emitting control instruction is a light-off instruction and the light-on delay timing is stopped, and the light-on delay timing can be directly cleared and reset or be cleared and reset after the control unit receiving the next light-on instruction. Similarly, the control unit stops timing when detecting that the timing value of the light-on delay timing reaches the delay threshold value, and controls the light emitting unit to emit light. The action of clearing or resetting of the light-on delay timing can be executed together with the action of stopping timing, or can also be executed when a next light-on instruction is received.

From the description above, it is clear that the solution provided in the embodiment of the present invention can satisfy the specific position detection requirement of the imaging device, and also can overcome the defects of misjudgment caused by manufacturing errors of the light emitting unit of the ink cartridge. In this solution, when the main body of the imaging device may have been sold and in use, there is no need to modify the main body of the imaging device, but only to modify the easy-consumed ink cartridges, therefore, it is easy to be implemented and popularized.

Embodiment Two

Figure 4B:
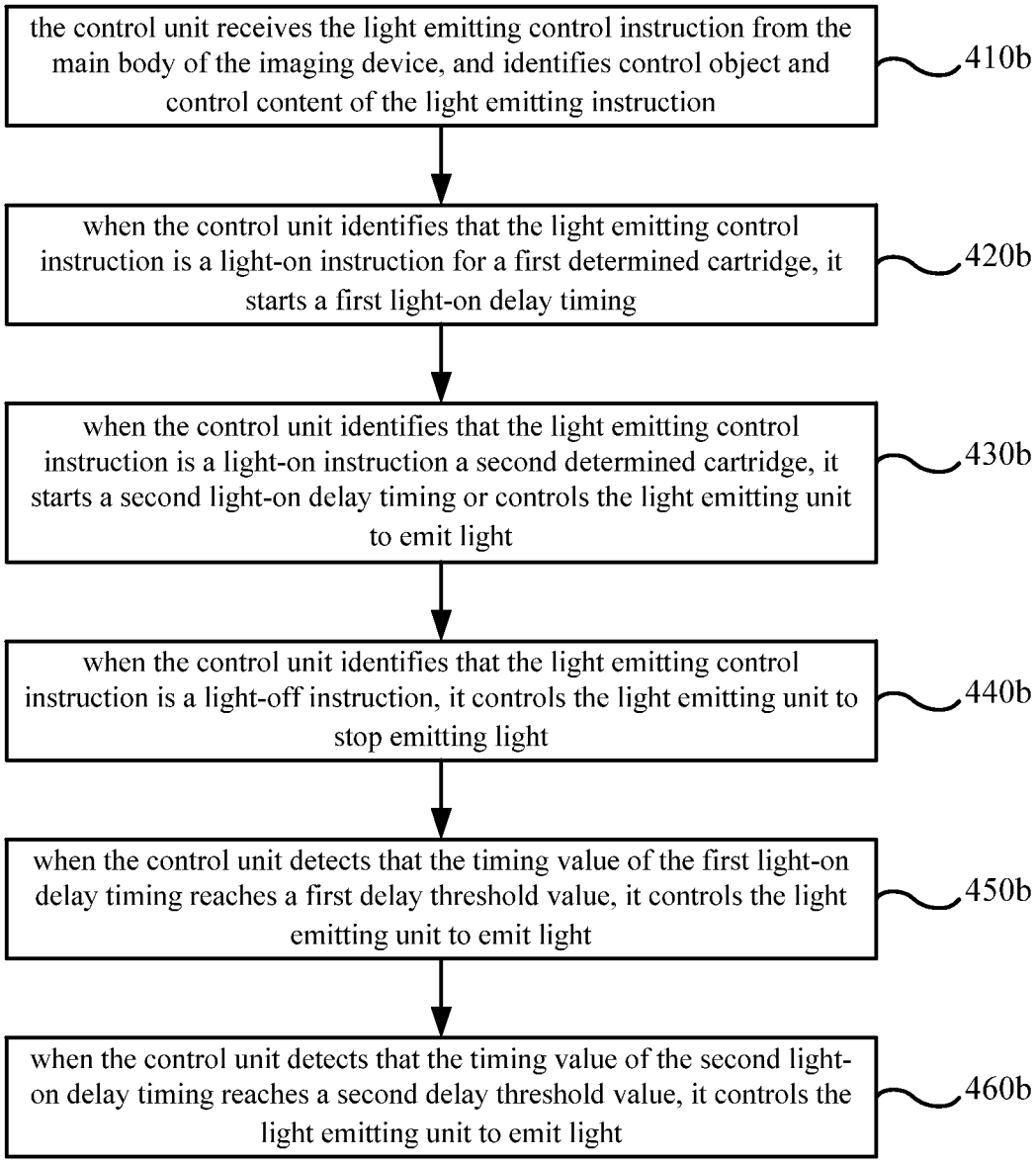
FIG. 4*b* is a schematic flow chart of a method for controlling light emission of the ink cartridge according to the second embodiment of the present invention.

FIG. 4*b* is a schematic flow chart of a method for controlling light emission of the ink cartridge according to a second embodiment of the present invention. The present embodiment is optimized based on the aforesaid embodiment. In this embodiment, the control unit not only carries out the time delay corresponding to the identified control content obtained from the light emitting control instruction, but also adapts different time delays corresponding to the different control objects identified from the light emitting control instruction.

Specifically, the operation of the control unit receives and identifies the light emitting control instruction from the imaging device, includes: the control unit receives the light emitting control instruction from the imaging device, and identifies control object and control content of the light emitting control instruction;

Specifically, the control unit starts a light-on delay timing when identifying that the light emitting control instruction is a light-on instruction, further includes: when the control unit identifies that the light emitting control instruction is an instruction for light-on a first determined ink cartridge, it starts a first light-on delay timing; when the control unit identifies that the light emitting control instruction is an instruction for light-on a second determined ink cartridge, it starts a second light-on delay timing or controls the light emitting unit to emit light.

Specifically, the control unit controls the light emitting unit to emit light when detecting that a timing value of the light-on delay timing reaches a delay threshold value, further includes: when detecting that the timing value of the first light-on delay timing reaches a first delay threshold value, the control unit controls the light emitting unit to emit light; when detecting that the timing value of the second light-on delay timing reaches a second delay threshold value, the control unit controls the light emitting unit to emit light.

The facing detection time period of the first determined ink cartridge is a first time period, and the adjacent position detection period of the first determined ink cartridge is a second period, such that the first delay threshold value is greater than the second time period and is less than the first time period. The facing detection time period of the second determined ink cartridge is a third time period, the second delay threshold value is less than the third time period.

For clearly description, a whole process of the present embodiment is introduced as follows:

Step 410*b*: the control unit receives the light emitting control instruction from the main body of the imaging device, and identifies control object and control content of the light emitting control instruction.

The main body of the imaging device controls the light emitting unit thereof to emit light by transmitting a light emitting control instruction to the control unit of each ink cartridge. The light emitting control instruction includes two types of information, which are: ink cartridge identifying information and light emitting control information. The ink cartridge identifying information is used for indicating the control object, that is, which ink cartridge it is. The light emitting control information is used for indicating the control content, that is, whether a light-on instruction or a light-off instruction it is.

Step 420*b*: when the control unit identifies that the light emitting control instruction is a light-on instruction for a first determined ink cartridge, it starts a first light-on delay timing.

Step 430*b*: when the control unit identifies that the light emitting control instruction is a light-on instruction for a second determined ink cartridge, it starts a second light-on delay timing or controls the light emitting unit to emit light.

In the aforesaid two steps, the first or second light-on delay timing may be the first time started, or reset a started timer and then restart. If the control objects are different types of ink cartridges, different delay times are used, or, they can be controlled to emit light immediately for a specific kind of ink cartridge. Therefore the control unit needs to identify the control object, and also needs to identify whether the control content is a light-on instruction or not. Order of identifying the control object and the control contend is not limited, and will be described in detail in the following text.

Step 440*b*: when the control unit identifies that the light emitting control instruction is a light-off instruction, it controls the light emitting unit to stop emitting light.

In this step, the control unit executes light-off action once identifying the control content is a light-off instruction, and doesn't need to distinguish which kind of ink cartridge the control object is.

Step 450*b*: when the control unit detects that the timing value of the first light-on delay timing reaches a first delay threshold value, it controls the light emitting unit to emit light.

Step 460*b*: when the control unit detects that the timing value of the second light-on delay timing reaches a second delay threshold value, it controls the light emitting unit to emit light.

A time interval of the facing position detection, when the main body of the imaging device takes the first determined ink cartridge as the ink cartridge to be detected, is a first time period T1, and a time interval of the adjacent position detection, when takes the first determined ink cartridge as the ink cartridge to be detected, is a second time period T2, then, the first delay threshold value t1 is greater than the second time period T2 and is less than the first time period T1. Further, a time interval of the facing position detection, when the main body of the imaging device takes the second determined ink cartridge as the ink cartridge to be detected, is a third time period T3. The second delay threshold value t2 is less than the third time period T3.

The main body of the imaging device can execute the adjacent position detection when the second determined ink cartridge is considered as the ink cartridge to be detected. Then, the time interval at this time is a fourth time period T4 and the second delay threshold value t2 is greater than the fourth time period T4. Or, the second determined ink cartridge does not need to executed the adjacent position detection when it is considered as the ink cartridge to be detected, due to some special reasons related to the second determined ink cartridge, such as the shape or the color.

The light emitting control instructions from the main body of the imaging device are mainly classified into two types, that is, light-on instruction and light-off instruction. In position detection technology of the imaging device, the light-on instruction and the light-off instruction will be transmitted successively to the corresponding ink cartridges when performing the facing position detection and the adjacent position detection, which is used to control the light emitting unit of the ink cartridge to emit light for a determined time period for position detection.

In the present embodiment, for the received light-on instruction, the ink cartridges will distinguish which type the control object of the light-on instructions are at first, and then judge whether to emit light immediately or not. There are a plurality of manners for classifying the type of the first determined ink cartridge and the second determined ink cartridge. For example, if the ink cartridges are distinguished according to colors, the first determined ink cartridge and the second determined ink cartridge can be an ink cartridge with a specific color or several ink cartridges with several specific colors. If the ink cartridges are distinguished according to positions, the first determined ink cartridge and the second determined ink cartridge can be an ink cartridges at a specific position or ink cartridges at several specific positions. According to different requirements, the second determined ink cartridge, which emits light directly, may have different settings.

There is no necessary relationship between which determined ink cartridge in which the control unit is located and which determined ink cartridge indicated by the control object of the light emitting control instruction is. The control unit could identify the control object by comparing the ink cartridge identifying information of the light emitting control instruction with the ink cartridge identifying information of the first determined ink cartridge and/or the second determined ink cartridge pre-stored in the control unit.

Since an imaging device will be installed with a plurality of ink cartridges, and the corresponding first time period of different ink cartridges, which are considered as the ink cartridge to be detected, may be the same with or different from each other, and the corresponding second time period may also be the same with or different from each other. If in a case they are different, the preferred first delay threshold value is greater than the greatest second time period of the imaging device, and is less than the smallest first time period.

Since the first delay threshold value t1 is greater than the second time period T2, the second delay threshold value t2 is inevitably greater than the fourth time period T4, or there is no fourth time period T4, that is, in the time period of adjacent position detection of all the ink cartridges, the light emitting unit does not emit light due to the delay, and in the time period of facing position detection, there is at least a light emitting time of T1-t1 or T3-t2 for detecting, after delayed a specific time. And, the second determined ink cartridge may emit light directly in case there is no need to perform adjacent position detection.

A detection result of the light receiver in the main body side of the imaging device is that, in T1 or T3 time period, light will still be received with a first light amount, and thus the facing position detection is judged to be correct. In T2 time period, light will not be received, the light amount is zero, which is inevitably less than the first light amount. According to this, it can be judged that the adjacent position detection is correct.

The preferred first and second delay threshold value configured for the control unit of each ink cartridge are set according to the corresponding first time period T1, the second time period T2, and the third time period T3 when it is considered as the ink cartridge to be detected. The preferred selection range of the first preferred delay threshold value is 200 ms, when the first time period is 300 ms to 2 s, and the second time period is 1 ms to 100 ms, is; and the second delay threshold value is 50 ms, which is less than the maximum value 100 ms of the third time period, when the third time period T3 is 1 ms to 100 ms.

In a situation that the time interval T5 between the light-off instruction and a next light-on instruction is relatively short, that is, when the first delay threshold value t1 or the second delay threshold value t2 of the light-on delay is greater than a sum of the second time period T2 and the time interval T5, the light-on delay timing may not be dealt with after receiving the light-off instruction till a next light-on instruction arrives, then the light-on delay timer is reset. Preferably, when the control unit identifies that the light emitting control instruction is a light-off instruction, it stops the first light-on delay timing or the second light-on delay timing, or resets the first light-on delay timing or the second light-on delay timing, so as to ensure that the light emitting unit will not emit light due to arrival of the delay time.

In a situation that a next received instruction is still a light-on instruction after receiving a light-on instruction, and the first light-on delay timing or the second light-on delay timing started by the previous light-on instruction has not been stopped or reset, the control unit can reset the started timer and then restart. After restarted, a third light-on delay timing is performed. The delay threshold value corresponding to the third light-on delay timing may be the same with or different from the first delay threshold value t1 or the second delay threshold t2. That is to say, the storing unit can preset a plurality of threshold values. Different threshold values are randomly adopted or invoked based on times of the received light-on instruction counted.

It can be seen from this, the solution provided by the embodiment of the present invention can satisfy the specific requirement of position detection technology of the imaging device, and can also overcome defects of misjudgment caused by manufacturing errors of the light emitting unit of the ink cartridge. In this solution, when the main body of the imaging device may have been sold and in use, there is no need to modify the main body of the imaging device, but only to modify the easy-consumed ink cartridges, therefore it is easy to be implemented and popularized.

The operation that the control unit identifies the control object and the control content of the light-on control instruction includes a plurality of manners.

A first manner is to identify the control content firstly and then identify the control object, that is:

Firstly, the control unit identifies whether the control content of the light-on control instruction is a light-on instruction or a light-off instruction;

When identifying that the light-on control instruction is a light-on instruction, the control unit identifies that the control object of the light-on instruction is the first determined ink cartridge or the second determined ink cartridge.

A second manner is to identify the control object firstly and then identify the control content, that is:

The control unit identifies whether the control object of the light-on control instruction is the first determined ink cartridge or the second determined ink cartridge;

Then, the control unit identifies whether the control content of the light-on control instruction of the first determined ink cartridge or the second determined ink cartridge is a light-on instruction or a light-off instruction.

A third manner is to identify the control object and control content simultaneously, that is:

The control unit identifies whether the control object of the light-on control instruction is the first determined ink cartridge or the second determined ink cartridge, and in the meanwhile, the control unit also identifies whether the control content of the light-on control instruction is a light-on instruction or a light-off instruction.

In the solution of the present embodiment, by setting a delay time for the light-on instruction of different ink cartridges, and the delay time is less than the time period of the facing position detection and is greater than the time period of the adjacent position detection, which could let the ink cartridges not emit light in the adjacent position detection stage to guarantee that the light amount of the adjacent position detection stage is less than the light amount of the facing position detection stage, thus avoiding the misjudgment problem that the position detection cannot be passed due to the light amount inconsistent caused by the manufacturing errors of the light emitting unit of the ink cartridge.

Embodiment Three

Figure 5:
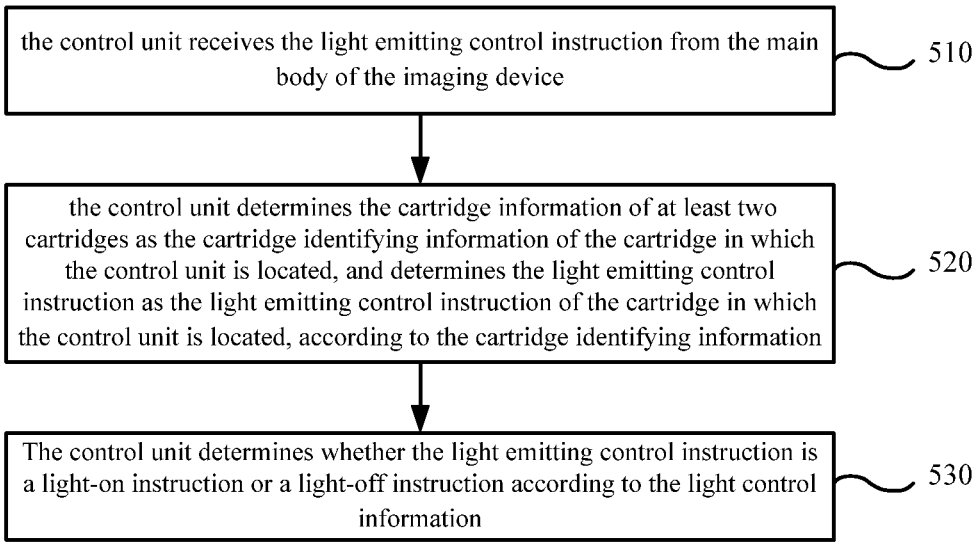
FIG. 5 is a schematic flow chart of a method for controlling light emission of the ink cartridge according to the third embodiment of the present invention.

FIG. 5 is a schematic flow chart of a method for light emission of the ink cartridge according to a third embodiment of the present invention. The present embodiment further optimizes the light-on operation based on the aforesaid embodiments. The interface units between each ink cartridge and the main body of the imaging device are commonly connected in one line, that is, the main body of the imaging device transmits a light-on control instruction of a certain ink cartridge to the control unit of all the ink cartridges. Therefore, the control unit of each ink cartridge needs to identify whether the control object of the light-on control instruction is the ink cartridge controlled by itself or not, which is generally determined according to the comparison result between the ink cartridge identifying information in the light emitting control instructions and the identifying information stored in the local storage units. This is a conventional manner used by a great deal of current main body of the imaging devices. The aforesaid embodiments may also use this solution. The control units of the ink cartridge execute the operations, such as illuminating, time delay, and/or extinguishing, only when receiving the light emitting control instruction for the local ink cartridges.

The present embodiment provides another preferred solution. Specifically, the ink cartridge control unit also executes corresponding actions, even when it received the light emitting control instructions for other ink cartridges. That is to say, one ink cartridge can execute operations, such as light-on, time delay, or light-off, according to the light emitting control instructions transmitted by the main body of the imaging device to at least two of or all the ink cartridges.

Specifically, the operation of the control unit receiving and identifying the light emitting control instruction from the main body of the imaging device includes the following steps:

Step 510: the control unit receives the light emitting control instruction from the main body of the imaging device, which includes the ink cartridge identifying information and the light control information;

For the main body of the imaging device, the ink cartridge identifying information is used for distinguishing the control objects, that is, for distinguishing the ink cartridges. The light control information is used for distinguishing the control content, that is, for distinguishing the light-on instruction or light-off instruction.

Step 520: the control unit determines the ink cartridge identifying information of at least two ink cartridges as the ink cartridge identifying information of the ink cartridge in which the control unit is located, and determines the light emitting control instructions as the light emitting control instructions of the ink cartridge in which the control unit is located, according to the cartridge identifying information.

The aforesaid step 520 is specifically the control unit is configured to identify the control object of the light emitting control instruction according to the ink cartridge identifying information, and to take the light emitting control instructions provided for the at least two ink cartridges as the light-on control instruction of the ink cartridge in which it is located. In the situation that the first determined ink cartridge and the second determined ink cartridge have to be distinguished in Embodiment Two, the control unit could directly execute control operation of Embodiment Two after identifying that which kind of determined cartridge the control object is, and also make some judgments further, for example, whether the light emitting control instruction is transmitted to the present ink cartridge, so as to determine whether to execute or not. That is to say, in that situation, the control unit identifies whether the control object of the light emitting control instruction is the first determined ink cartridge or the second determined ink cartridge according to the ink cartridge identifying information, and determines the ink cartridge identifying information of the at least two first determined ink cartridges as the ink cartridge identifying information of the ink cartridge in which the control unit is located. For example, a red ink cartridge and a black ink cartridge are both seen as the first determined ink cartridges, after the control object of the light emitting control instruction is identified that as the red ink cartridge or the black ink cartridge, even if the ink cartridge in which the control unit is located is not a red ink cartridge or a black ink cartridge, the control unit will still consider the light emitting control instruction transmitted to the red ink cartridge or black ink cartridge as the light emitting control instruction transmitted to the ink cartridge in which the control unit is located.

Step 530: The control unit determines whether the light emitting control instruction is a light-on instruction or a light-off instruction according to the light control information.

As described above, through the solution of the present embodiment, an ink cartridge will execute operations, such as light-on, time delay, or light-off, according to the light emitting control instruction transmitted by the imaging device to at least two ink cartridges, or even all of the ink cartridges. That is, in the facing position detection stage, not only the ink cartridge to be detected can emit light, the light emitting units of at least one another or all of the ink cartridges will also emit light. Therefore, the light amounted received by the light receiver is inevitably greater than the light amount of a single ink cartridge, that is, the light amounted received by the light receiver is inevitably greater than the preset threshold value. The solution solves the defect of receiving insufficient light amount of the light emitting unit caused by manufacturing error or insufficient battery, and decreases misjudgment rate effectively.

Embodiment Four

The ink cartridge light emitting control method provided by Embodiment Four is based on Embodiment Three, which provides a preferred embodiment of an manner to identify ink cartridge. The Table 1 below shows ink cartridge information adapted for Embodiment Four:

TABLE 1

| Ink cartridge Identifying Information | | | | Light Control Information | | | |
|---|---|---|---|---|---|---|---|
| Ink cartridge BK | 0 | 0 | 0 | 1 | 0 | 0 | Light-On |
| Ink cartridge C | 1 | 0 | 0 | | | | (ON) |
| Ink cartridge M | 0 | 1 | 0 | 0 | 0 | 0 | Light-Off |
| Ink cartridge Y | 1 | 1 | 0 | | | | (OFF) |

The ink cartridge identifying information includes at least two bits of logic value. The ink cartridge identifying information of Table 1 are codes used by printer for distinguishing different ink cartridges. In this embodiment, the ink cartridge color information is considered as the identifying information of the ink cartridge. However, other information may be chosen as the identifying information or the codes, as long as the ink cartridges can be distinguished. The light emitting control information are codes used for controlling the aforesaid light emitting units to be on or off, that is, light-on/light-off (ON/OFF) operation. As shown in table 1, "100" refers to ON action, which means actuating the light emitting unit to emit light, "000" refers to OFF action, which means extinguishing the light emitting unit. Other codes may also be used to represent the two operations, as long as the two operations can be distinguished. any code of ink cartridge identifying information and any code of ink cartridge light emitting control information are combined to construct a light-on/light-off control instruction for any light emitting unit of ink cartridges have different colors. For example, "000100" represents actuating the light emitting unit of the BK ink cartridge to emit light; "100000" represents extinguishing the light emitting unit of the C ink cartridge.

Hence, the operation of the control unit determines the ink cartridge identifying information of the at least two ink cartridge as the ink cartridge identifying information of the ink cartridge in which it is located can be executed as follows:

The control unit abandons apart of bits of or all bits of the logic value in the ink cartridge identifying information;

The control unit determines the received ink cartridge identifying information as the ink cartridge information of the ink cartridge in which it is located according to the remaining bits of the logic value in the ink cartridge identifying information and the corresponding bits of the logic value of the identifying information of the ink cartridge in which it is located.

The solution for the situation that the first determined ink cartridge and the second determined ink cartridge needed to be distinguished is could adopt a similar solution described below, that is: the ink cartridge identifying information includes at least two bits of logic value, and the control unit identifies whether the control object of the light emitting control instruction is the first determined ink cartridge or the second determined ink cartridge according to the ink cartridge identifying information. For example, specially, the operation of determining the at least two first determined ink cartridge identifying information as the ink cartridge in which the control unit is located, including the steps below:

The control unit abandons a part of bits of or all bits of logic value in the ink cartridge identifying information of the first determined ink cartridge;

The control unit determines the received ink cartridge identifying information as the ink cartridge identifying information of the ink cartridge in which it is located, according to the comparison result between the remaining bits of logic value in the ink cartridge identifying information of the first determined ink cartridge and corresponding bits of logic value of the identifying information of the ink cartridge in which it is located.

In the aforesaid embodiment, if all bits of the logic value are abandoned, there is no remaining bit of logic value. Since there is no ink identifying information, the situation of the light emitting control instruction is inconsistent with the corresponding bits of the ink cartridge identifying information stored in the ink cartridge itself would not appear, thus the light emitting control instruction could be directly determined to be transmitted to the ink cartridge in which the control unit itself is located in at this moment. If only a part of bits of the logic value are abandoned, the ink cartridge control unit can only compare whether the remaining bits of logic value are consistent with the corresponding bits of the ink cartridge identifying information stored in the ink cartridge itself. Since the abandoned logic value will not appear to be inconsistent with the corresponding bits of the ink cartridge identifying information stored in the ink cartridge itself, so that the light emitting control instruction of a part of the ink cartridges are still considered as the light emitting control instruction of the present cartridge which the control unit located in.

The aforesaid solution is specifically adaptive for the situation shown in FIG. 2*a*, in which the electrical contact 302 is considered as an interface unit, which is connected to the ink cartridge and the main body of the imaging device in form of electrical contact 302. The electrical contact receives high voltage or low voltage transmitted by the main body of the imaging device to form an instruction with at least two bits of logic value. Generally, a range of high level voltage is 3.5V-5V, which is represented by digital logic "1", and a range of low level voltage is 0-1.5V, which is represented by digital logical "0".

Therefore, the control units could consider the light emitting control instructions of a plurality of ink cartridges as instructions transmitted to the present ink cartridge. If the delay threshold values adopted by the control units of the plurality of ink cartridges are the same, the plurality of ink cartridges with these control units will emit light simultaneously when responded with any control instructions transmitted to different ink cartridges. If the first delay threshold values and the second threshold values used by the respective control unit are the same, the situation of emitting light simultaneously will appear.

Embodiment Five

Figure 6A:
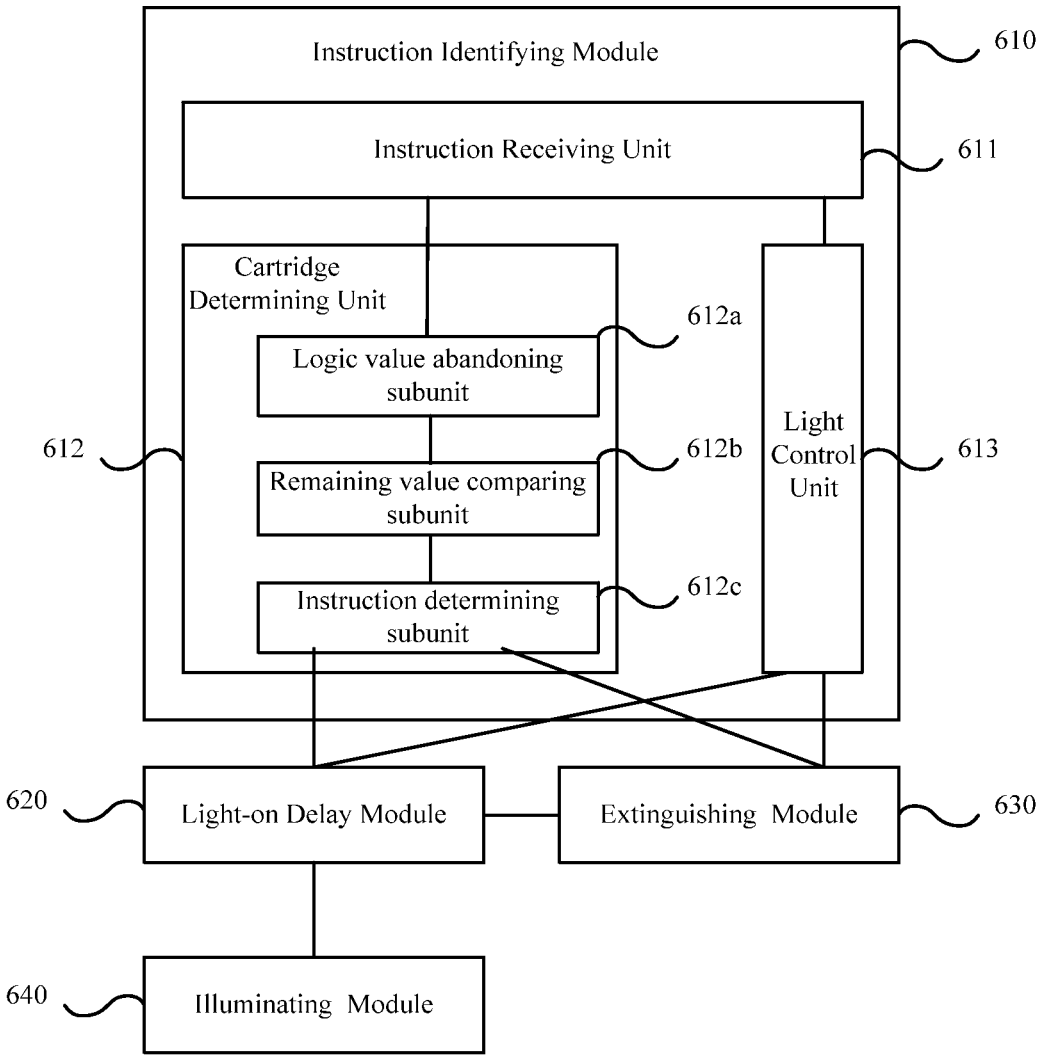
FIG. 6*a* is a schematic structural diagram of a control unit used for controlling the light emission of an ink cartridge according to a fifth embodiment of the present invention.

FIG. 6*a* is a schematic structural diagram of a control unit used for controlling the light emission of an ink cartridge according to a fifth embodiment of the present invention. The control unit is disposed on an ink cartridge detachably mounted on the main body of the imaging device, and a light receiver is disposed on the main body of the imaging device. The ink cartridge includes an interface unit configured to receive the signal from the main body of the imaging device, a storing unit configured to store relevant information of the ink cartridge, and a light emitting unit configured to emit light to the light receiver disposed on the main body of the imaging device. The main body of the imaging device has at least two ink cartridges. The light emitting unit could be arranged at a position facing the light receiver. Or, the light emitted by the light emitting unit could be emitted toward the light receiver by the other optical components arrangement. The control unit specifically includes: an instruction identifying module 610, a light-on delay module 620, an extinguishing module 630, and an illuminating module 640.

The instruction identifying module 610 is configured to receive and identify the light emitting control instruction from the main body of the imaging device. The light-on delay module 620 is configured to start a light-on delay timing when identifying that the light emitting control instruction is a light-on instruction. The extinguishing module 630 is configured to control the light emitting unit on the ink cartridge to stop emitting light when identifying that the light emitting control instruction is a light-off instruction. The illuminating module 640 is configured to control the light emitting unit on the ink cartridge to emit light when detecting that the timing value of the light-on delay timing reaches a delay threshold value. The time interval of the main body of the imaging device for detecting the facing position detection of the ink cartridge to be detected is a facing detection time period, which can be marked as a first time period. The time interval for adjacent position detection of the ink cartridge to be detected is adjacent position detection time period, which can be marked as a second time period. The delay threshold value is greater than the adjacent detection time period and less than the facing detection time period.

The control unit provided in the present embodiment may execute the light emitting control method of the ink cartridge provided in the embodiments of the present invention, which has corresponding functional modules. The functional modules may be implemented by hardware and also by software, and be integrated in a chip in form of a controller. Person skilled in the art would understand that, a part of or all of the units, except for the modules that exist in form of a hardware circuit, may be replaced by computer program, which is not limited here.

Preferably, the control unit further includes a timing control module 650, which is configured to, when the control unit identifies that the light control instruction is a light-off instruction, stop the light-on delay timing, or reset the light-on delay timing, thereby avoiding illuminating in error.

In the present embodiment, preferably, the instruction identifying module 610 includes an instruction receiving unit 611, an ink cartridge determining unit 612, and a light control unit 613. More specially, the instruction receiving unit 611 is configured to receive light control instructions, and each of which include ink cartridge identifying information and light control information. The ink cartridge determining unit 612 is configured to determine the ink cartridge identifying information of at least two ink cartridges as the light emitting control instructions of the ink cartridge in which it is located, according to the ink cartridge identifying information, and determine that the light control instructions of the at least two ink cartridges are the light emitting control instruction of the ink cartridge in which it is located, according to the determining results of the ink cartridge identifying information. The light control unit 613 is configured to determine whether the instruction is a light-on instruction or a light-off instruction according to the light control information. As described above, preferably, the light emitting unit of a plurality of ink cartridges would emit light simultaneously or successively in the facing position detection stage of any ink cartridge to ensure the facing position detection stage could be accepted by the printer. The aforesaid ink cartridge identifying information preferably includes at least two bits of logic value, the ink cartridge determining unit 612 includes: a logic value abandoning subunit 612*a*, a remaining value comparing subunit 612*b*, and an instruction determining subunit 612*c*. The logic abandoning subunit 612*a* is used for abandoning a part of bits of or all bits of logic value of the ink cartridge identifying information. The remaining value comparing subunit 612*b* is configured for determining that the received ink cartridge identifying information is the ink cartridge identifying information of the ink cartridge in which it is located, according to the comparison result between the remaining bits of logic value in the ink cartridge identifying information and the corresponding bits of logic value of the identifying information of the ink cartridge in which it is located. The instruction determining subunit 612*c* is configured for determining that the light emitting control instruction is the light emitting control instruction of the ink cartridge in which it is located, according to the determining result of the ink cartridge identifying information.

For the above solution, if the logic value is received or transmitted via the electrical contacts, preferably, the electrically connection between the logic value abandoning subunit 612*a* and the electrical contacts, which is arranged on the ink cartridge in which the control unit is located and used for receiving the respective logic value, is turn on or cut off by shifting a switch, so as to realize the abandon of the bit logic value when it is cut off. Or, the abandon of the logic value can also be predetermined.

Embodiment Six

Figure 6B:
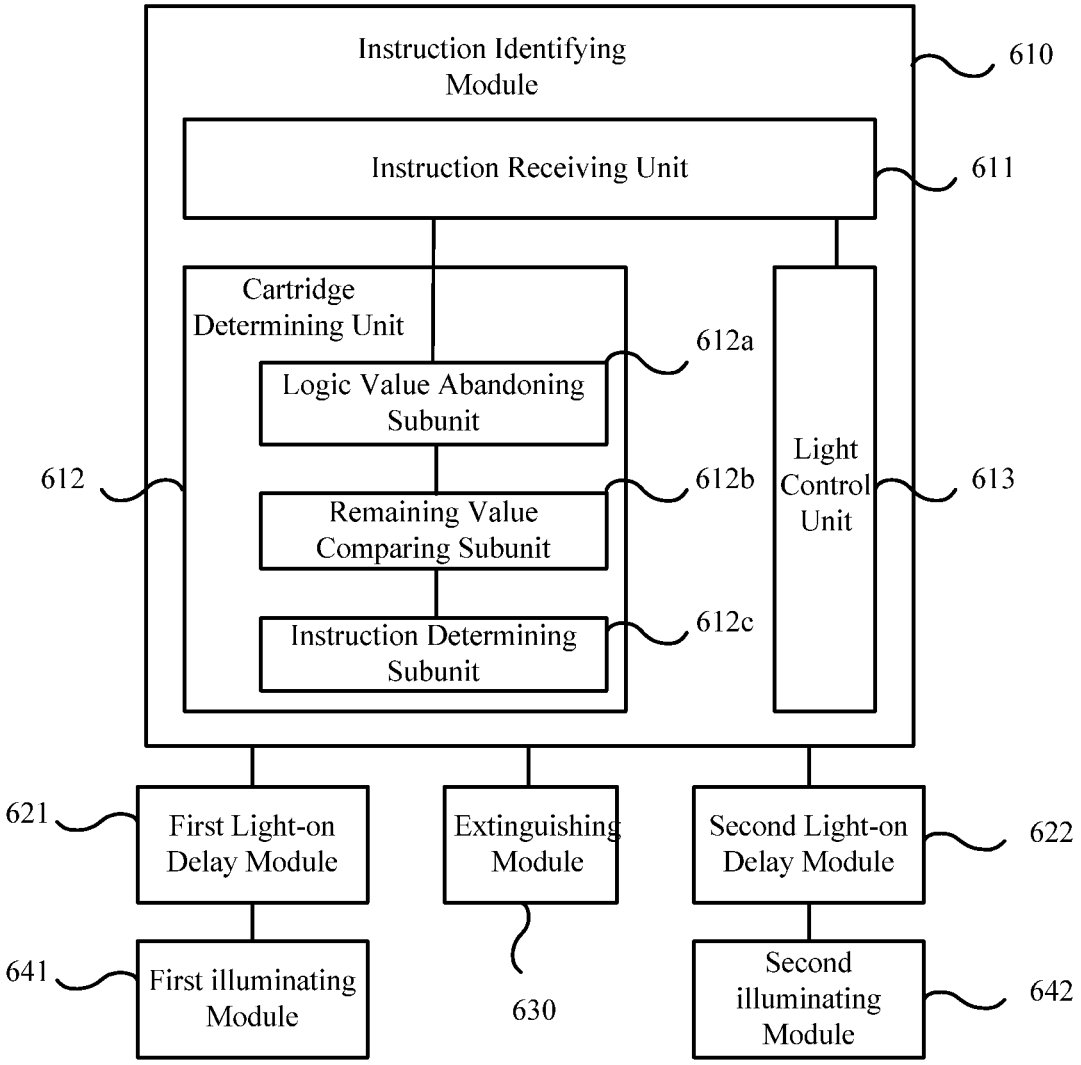
FIG. 6*b* is a schematic structural diagram of a control unit used for controlling the light emission of an ink cartridge according to a sixth embodiment of the present invention.

FIG. 6*b* is a schematic structural diagram of a control unit used for controlling the light emission of an ink cartridge according to a sixth embodiment of the present invention. The control unit is detachably installed on the ink cartridge of the main body of the imaging device, and the main body of the imaging device is provided with a light receiver. The ink cartridge includes an interface unit for receiving signal transmitted by the main body of the imaging device, a storing unit for storing relevant information of the ink cartridge, a light emitting unit for emitting light to the light receiver disposed on the main body of the imaging device, and the main body of the imaging device is provided with at least two ink cartridges. The light emitting unit could be arranged at a position facing the light receiver. Or, the light emitted by the light emitting unit could be emitted toward the light receiver by the other optical components arrangement, such as the optical refraction components. The control unit specifically includes: an instruction identifying module 610, a light-on delay module 620, a extinguishing module 630, and a illuminating module 640.

The light-on delay module 620 includes a first light-on delay module 621 and a second light-on delay module 622. The illuminating module 640 includes a first illuminating module 641 and a second illuminating module 642.

The instruction identifying module 610 is specifically used for receiving the light emitting control instruction from the main body of the imaging device, and identifying the control object and control content of the light emitting control instruction received. The first light-on delay module 621 is used for starting the first light-on delay timing when identifying that the light emitting control instruction is for illuminating the first determined ink cartridge. The second light-on delay module 622 is used for starting a second light-on delay timing or controlling the light emitting unit to emit light, when identifying that the light emitting control instruction is for illuminating the second determined ink cartridge. The light extinguishing module 630 is used for controlling the light emitting unit of the ink cartridge to stop emitting light, when identifying that the light emitting control instruction is a light-off instruction. The first illuminating module 641 is used for controlling the light emitting unit of the ink cartridge to emit light when detecting that the timing value of the first light-on delay timing reaches the first delay threshold value. The second illuminating module 642 is used for controlling the light emitting unit to emit light when detecting that the timing value of the second light-on delay timing reaches a second delay threshold value.

The facing detection time period of the first determined ink cartridge is a first time period, and the adjacent position detection time period of the first determined ink cartridge is a second time period, then, the first delay threshold value is greater than the second time period and less than the first time period. The facing detection time period of the second determined ink cartridge is a third time period, and the second delay threshold value is less than the third time period.

That is, a time interval of the facing position detection, when the main body of the imaging device takes the first determined ink cartridge as the ink cartridge to be detected, is a first time period T1, and a time interval of the adjacent position detection, when the first determined ink cartridge is taken as the ink cartridge to be detected, is a second time period T2, then, the first delay threshold value t1 is greater than the second time period T2, and is less than the first time period T1. A time interval of the facing position detection, when the main body of the imaging device takes the second determined ink cartridge as the ink cartridge to be detected, is a third time period T3. The second delay threshold value t2 is less than the third time period T3.

The control unit provided in the embodiment of the present invention may execute the method for light emission of the ink cartridge provided by the embodiments of the present invention; the control unit has corresponding functional modules. The functional modules may be implemented by hardware and also by software, and may be integrated in a chip in form of a controller. Person skilled in the art would understand that, a part of or all of the units, except for the modules exist in form of a hardware circuit, may be replaced by computer program, which is not limited here.

The control unit preferably includes a timing control module, which is configured to, when the control unit identifies that the light control instruction is a light-off instruction, stop the first light-on delay timing or the second light-on delay timing, or reset the first light-on delay timing or the second light-on delay timing, thereby avoiding illuminating in error.

In the present embodiment, the instruction identifying modules with different structures and functions may be provided according to different identifying modes.

The first instruction identifying module identifies the control content at first, then identifies the control object, in other words, the first instruction identifying module including:

A instruction receiving unit, configured to receive the light emitting control instruction from the main body of the imaging device;

A first content identifying unit, configured to identify whether the control content of the light emitting control instruction is a light-on instruction or a light-off instruction;

A first object identifying unit, configured to, when identifying that the light emitting control instruction is a light-on instruction, identify whether the control object of the light emitting control instruction is the first determined ink cartridge or the second determined ink cartridge.

The second instruction identifying module identifies that the control object at first and then identifies the control content, in other words, the second instruction identifying module including:

An instruction receiving unit, configured to receive the light emitting control instruction from the main body of the imaging device;

A second object identifying unit, configured to identify whether the control object of the light emitting control instruction is the first determined ink cartridge or the second determined ink cartridge;

A second content identifying unit, configured to identify whether the control content of the light emitting control instruction of the first determined ink cartridge or whether the second determined ink cartridge is a light-on instruction or a light-off instruction;

A third instruction identifying module identifies the control object and the control content simultaneously, in other words, the third instruction identifying module including:

A instruction receiving unit, configured to receive the light emitting control instruction from the main body of the imaging device;

A third object and content identifying unit, configured to identify whether the control object of the light emitting control instruction is the first determined ink cartridge or the second determined ink cartridge, and in the meanwhile identify whether the control content of the light emitting control instruction is a light-on instruction or a light-off instruction.

In addition, in the present embodiment, the instruction identifying module 610 preferably includes an instruction receiving unit 611, an ink cartridge determining unit 612, and a light control unit 613. The instruction receiving unit 611 is configured to receive the light emitting control instruction from the main body of the imaging device, which includes ink cartridge identifying information and light control information. The ink cartridge determining unit 612 is configured to identify whether the control content of the light emitting control instruction is the first determined ink cartridge or the second determined ink cartridge according to the ink cartridge identifying information, and determine the ink cartridge identifying information of at least two first determined ink cartridge as the ink cartridge identifying information of the ink cartridge in which it is located, and determine the light emitting control instruction as the light emitting control instruction of the ink cartridge in which it is located, according to the determining result of the ink cartridge identifying information. The light control unit 613 is configured to determine whether the instruction is a light-on instruction or a light-off instruction according to the light control information. As described before, preferably, the light emitting unit of a plurality of ink cartridges would emit light simultaneously or successively in the facing position detection stage of any ink cartridge to ensure the facing position detection stage could be accepted by the printer.

In the above solution, the ink cartridge information may include at least two bits of logic value, the ink cartridge determining unit includes a logic abandoning subunit, a remaining value comparing subunit and an instruction determining subunit. The logic value abandoning subunit is configured to abandon a part of bits of or all bits of logic value in the ink cartridge identifying information of the first determined ink cartridge. The remaining value comparing subunit is configured to determine that the received ink cartridge identifying information is the ink cartridge in which it is located, according to the comparison result between the remaining bits of logic value in the ink cartridge identifying information of the first determined ink cartridge and the corresponding bits of logic value of the identifying information of the ink cartridge in which the controller is located. The instruction determining subunit is configured to determine that the light emitting control instruction is the light emitting control instruction of the ink cartridge in which it is located, according to the determining result of the ink cartridge identifying information. Preferably, the electrically connection between the logic value abandoning subunit and the electric contacts which are arranged in the cartridge in which the control unit is located and used for receiving the respective bit logic value are turned on or cut off by shifting a switch.

Embodiment Seven

Referring to FIG. 2*a* and FIG. 2*b*, the circuit board for controlling the light emission of ink cartridge provided by Embodiment Seven includes an interface unit configured to receive signals transmitted by the main body of the imaging device, a storage unit and a control unit 304. The storage unit is configured to store relevant information of the ink cartridge, which may be various kinds of storage. The interface unit and storage unit are respectively connected to the control unit 304. The control unit 304 adopts the control unit for controlling the light emission of the ink cartridge provided by any embodiment of the present invention.

The preferred interface unit is an electric contact 302, as shown in FIG. 2*a* and FIG. 2*b*, which is configured to receive high level voltage or lower level voltage transmitted by the main body of the imaging device, to form an instruction having at least two bits of logic value.

The circuit board may be provided with a light emitting unit connected to the control unit 304 thereon, such as an LED light 304, which is disposed on the circuit board used to control the light emission of the ink cartridge to emits light toward the light receiver of the main body of the imaging device. Or, the light emitting unit could be separated from the circuit board, and disposed on other parts of the main body of the ink cartridge.

Embodiment Eight

The present Embodiment Eight provides an ink cartridge, which includes a main body of an ink cartridge, and the circuit board for controlling the light emission of ink cartridge provided in any embodiment of the present invention. Installing position of the circuit board on the main body of the ink cartridge may be referred to FIG. 1*a*, FIG. 1*b* and FIG. 1*c*. The structure of the main body of the ink cartridge is not limited in FIG. 1*a*, FIG. 1*b* and FIG. 1*c*.

The ink cartridge further includes: a light emitting unit which emits light toward the light receiver of the main body of the imaging device, and is connected to the control unit. The light emitting unit is disposed on the circuit board or on the main body of the ink cartridge. The light emitting unit is a component illuminated by electricity, which specifically may be a light emitting diode (Light Emitting Diode, LED), a laser diode, a Fluorescent light, a tungsten wire light etc., which it is not limited here. The emitted light may be visible light or invisible light.

Embodiment Nine

Figure 7:
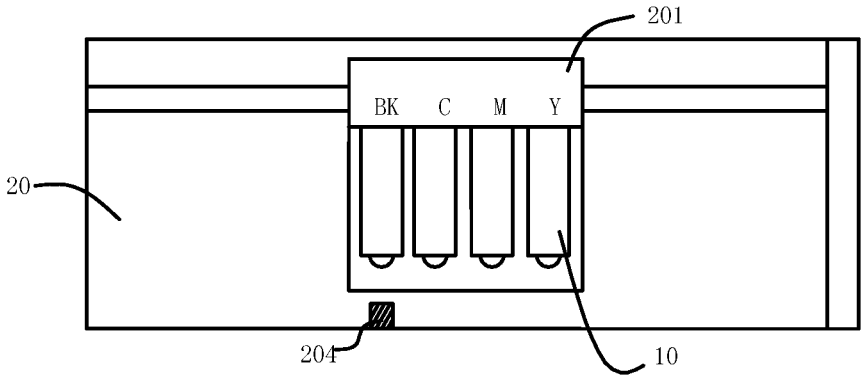
FIG. 7 is a schematic structural diagram of an imaging device according to a ninth embodiment of the present invention.
Figure 8:
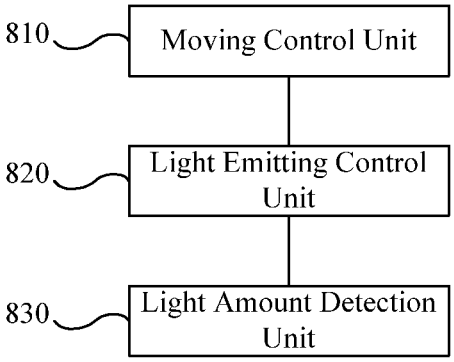
FIG. 8 is a schematic structural diagram of a position detection module of an imaging device according to a tenth embodiment of the present invention.

FIG. 7 is a schematic structural diagram of an imaging device according to a ninth embodiment of the present invention. The imaging device 20 may includes a main body of an imaging device and at least two ink cartridges 10. The main body of the imaging device includes at least a light receiver 204, a carriage 201, and a position detection module. The at least two ink cartridges 10 are fixedly mounted on the carriage 201. The carriage 201 is movably disposed relative to the light receiver 204. The ink cartridges 10 use the ink cartridges provided in any embodiment of the present invention. The interface unit of each ink cartridge 10 is commonly connected to an instruction output terminal of the main body of the imaging device via one line, such as connected by electrical contacts. The position detection module may be implemented by hardware or software, specifically, can be a control component of the main body of the imaging device. The position detection module shown in FIG. 8 includes: a moving control unit 810, a light emitting control unit 820, and a light amount detection unit 830. The moving control unit 810 is configured to control the carriage to move to the position where the ink cartridge to be detected is facing the light receiver. The light emitting control unit 820 is configured to transmit the light emitting control instruction to the ink cartridge, so as to control the light emitting unit to emit light in the facing detection time period of the ink cartridge to be detected and the adjacent detection time period of the adjacent position detection. The light amount detection unit 830 is configured to determine that the position of ink cartridge to be detected is correct, when identifying that the first light amount received in the direct opposite detection time period is greater than the first preset light amount, and the second light amount received in the adjacent detection time period is less than the first light amount, or when identifying that the third light amount received in the direct opposite detection time period is greater than the third preset light amount.

In the situation that the first determined ink cartridge and the second determined ink cartridge do not need to be distinguished, the facing detection time period of each ink cartridge can be uniformly marked as a first time period, and the adjacent detection time period of each ink cartridge is marked uniformly as a second time period. More specially, the light emitting control unit 820 is used for controlling the light emitting unit of the ink cartridge to be detected to emit light in the first time period of its facing position detection and the second time period of its adjacent position detection, by transmitting the light emitting control instructions to the ink cartridges. The light amount detection unit 830 is configured to, when identifying that the first light amount received in the first time period is greater than the first preset light amount and the second light amount received in the second time period is less than the first light amount, determine that the position of the ink cartridge to be detected is correct.

In the situation that the first determined ink cartridge and the second determined ink cartridge need to be distinguished, the facing detection time period of the first determined ink cartridge may be uniformly marked as a first time period, and the adjacent detection time period of the first determined ink cartridge is marked as a second time period, while the facing detection time period of the second determined ink cartridge is marked as a third time period. More specially, the light emitting control unit is specifically used for controlling the light emitting unit of the ink cartridge to be detected to emit light in the first time period or the third time period of its facing position detection and the second time period of its adjacent position detection, by transmitting the light emitting control instruction to the ink cartridge. The light amount detection unit is configured to, when identifying that the first light amount received in the first time period is greater than the first preset light amount and the second light amount received in the second time period is less than the first light amount, or the third light amount received in the third light amount is greater than the third preset light amount, determine that the position of the ink cartridge to be detected is correct. The first preset light amount and the third preset light amount may be same or different.

There may be a lot of control manners used for the light emitting control unit 820, such as, generating and transmitting the light-on instruction for controlling the ink cartridge to be detected, and generating and transmitting the light-off instruction after the first time period or the third time period; and furthermore, generating and transmitting the light-on instruction for controlling the adjacent ink cartridge of the ink cartridge to be detected before or after the first time period, and generating and transmitting the light-off instruction after the first time period.

Or, the light emitting control unit 820 could generate and transmit the light-on instruction for controlling the ink cartridge to be detected, and generate and transmit the light-off instruction after a sum of the first time period and the second time period.

Preferably, the light amount detection unit is specifically configured to, when identifying that the first light amount received in the facing detection time period is greater than the first preset light amount, and the second preset light amount received in the adjacent detection time period is less than the first light amount and the second preset light amount, determine that the position of the ink cartridge to be detected is correct.

For an imaging device provided with a plurality of ink cartridges, the corresponding facing detection time periods of different ink cartridges being considered as the ink cartridge to be detected may be different from each other, and the corresponding adjacent detection time periods may also be different from each other. Hence, the delay threshold value configured for control unit of the cartridge is greater than the greatest adjacent detection time period of the imaging device and less than the least facing detection time period. The delay thresholds value configured for different ink cartridge control units may also be the same with or different from each other. If the facing detection time period and the adjacent detection time period of each of the plurality of ink cartridges considered as ink cartridge to be detected are the same, the delay threshold value, configured for each ink cartridge control unit, only needs to satisfy the rules of "greater than the adjacent detection time period and less than the facing detection time period". For the case of distinguishing the first determined ink cartridge and the second determined ink cartridge, the first delay threshold value configured for each ink cartridge control unit is greater than the greatest second time period (the adjacent light detection time period of the first determined ink cartridge) and less than the minimum first time period (the facing position detection time period of the first determined ink cartridge). The first delay threshold value of different ink cartridge control units may be the same with or different from each other.

The circuit board, the ink cartridge, and the imaging device provided in the embodiments of the present invention can effectively avoid position detection misjudgment caused by the ink cartridge light emitting unit or other manufacturing error factors via changing light emitting control strategy of the ink cartridge side, thereby preventing the situation that "the ink cartridge installed in a correct position is considered as being installed in a wrong position", and providing selectivity to users, decreasing usage cost for users. The imaging device may be an inkjet printer, a copier, or a facsimile machine etc. The solution is especially adaptive for printers with "continuously ink supply system". Sometimes printer covers are difficult to be closed entirely because of ink providing pipe arrangement problems in continuously ink supply printers. The ink cartridges are easily interfered by outside light during the aforesaid detection, and the misjudgment rate will become greater.

In order to clearly introduce the ink cartridge light emitting control solution provided in the embodiments of the present invention, the position detection process will be described as follows based on an actual example.

In the actual example, as shown in FIG. 1*c*, the imaging device is an inkjet printer which can be installed with four colors of ink cartridge, BK ink cartridge, C ink cartridge, Y ink cartridge, and M ink cartridge, mounted on the carriage of the printer successively.

During the position detection process of the printer, the moving and detection order of the plurality of ink cartridges are shown as below:

$$\frac{BKon - BKoff - Con}{BKposition} \rightarrow \text{moving} \rightarrow \frac{Coff - BKon - BKoff}{Cposition} \rightarrow \text{moving} \rightarrow \frac{Mon - Moff - Con - Coff}{Mposition} \rightarrow \text{moving} \rightarrow \frac{Yon - Yoff - Mon - Moff}{Yposition}$$

Combining the order of the ink cartridge movement and the light emitting control, the position detection of the printer is started from BK ink cartridge and ended at Y ink cartridge, which is detected one by one along the moving direction of the carriage. Furthermore, the adjacent position detection mainly detects the ink cartridge arranged adjacent to the ink cartridge to be detected in the moving direction of the carriage or the direction opposite to the moving direction of the carriage. For example, when the BK ink cartridge and the M ink cartridge are as the cartridge to execute the facing position detection, the adjacent position detection stage of them are to detect the C ink cartridge, which is arranged adjacent to them is the moving direction and the direction opposite to the moving direction. Additionally, since the C ink cartridge needs to execute the adjacent position detection of the BK ink cartridge and the facing position detection of itself, in order to save steps, in the present embodiment, the printer merges the light-on/light-off instruction transmitted to the LED light of the C ink cartridge during the two detection processes. That is to say, the printer only transmits one light-on/light-off instruction in pair, and extends the light-on time to achieve the purpose of executing the two detection processes. Therefore, the time interval between C ON and C OFF, which are the light emitting control instructions transmitted after the facing position detection of BK ink cartridge, includes time for executing the adjacent position detection of the BK ink cartridge and time for executing the facing position detection of the C ink cartridge. For this situation, adopting the aforesaid solution that executing the light emission control of LED after a predetermined time delay also could avoid the execution of the adjacent position detection, because the actual delayed time period in this situation is the original adjacent position detection time period of BK ink cartridge.

Table 2 shows the time intervals between the respective control signals transmitted by the printer when the respective ink cartridge executes the facing position detection and the adjacent position detection, and the detection types of the control signals in the present example. The time interval Δt represents the time interval between a previous instruction and a next instruction. For example, the time interval between the two control signals of BK ON and BK OFF is 800 ms, and the time interval between the BK OFF and C ON is 90.2 ms. N and P in the detection types respectively represent the adjacent position detection stage and the facing position detection stage, N+P represents the stage includes the adjacent position detection and the facing position detection.

TABLE 2 time interval between the control signals, and detection types

| Control Signal | Time Interval Δ t | Detection Type | Control Signal | Time Interval Δ t | Detection Type |
|---|---|---|---|---|---|
| BK ON | 800 ms | P | C ON | 94 ms | N |
| BK OFF | 90.2 ms | | C OFF | 8.9 ms | |
| C ON | 424 ms | N + P | Y ON | 362 ms | P |
| C OFF | 87.8 ms | | Y OFF | 45 ms | |
| BK ON | 94.7 ms | N | M ON | 87 ms | N |
| BK OFF | 7 ms | | M OFF | / | |
| M ON | 398 ms | P | | | |
| M OFF | 78.6 ms | | | | |

In order to describe conveniently, the light emitting control instruction transmitted by the printer is expressed directly by "color ID+light emitting control information" hereinafter. For example, the instruction of BK ON represents driving the light emitting unit of the black ink cartridge to emit light, and the instruction of BK OFF represents controlling the light emitting unit of the black ink cartridge to be turned off.

According to Δ t and the detection type and the detection sequence of the aforesaid ink cartridges shown in the Table 2, it is known that, when the ink cartridge is in facing position detection stage, the time interval between the light-on instruction for controlling the LED to emit light and the light-off instruction for controlling the LED to be extinguished is relative great, while all is greater than 300 ms. But, when the ink cartridge is in adjacent position detection stage, the time interval between the light-on instruction and light-off instruction is less, while all is substantially less than about 100 ms. For this reason, in the present embodiment, preferably, the delay threshold value of the time delay is set as 200 ms. Thus, when the plurality of ink cartridges execute the aforesaid position detection process, not only the facing position detection stage can be guaranteed to be corrected, the adjacent position detection can also be avoided to execute, thereby ensuring normal operation of the ink cartridge with normal function, even if the LED brightness is a bit weak.

Additionally, known from the Table 2, the time interval between the instruction of C ON and the instruction of C OFF is 424 ms, while the time interval includes an adjacent position detection stage of the BK ink cartridge, which is taken up the first half of it and a facing position detection stage of the C ink cartridge itself, which is taken up the second half of it. Thus, when the instruction of C ON is executed after being delayed 200 ms, the adjacent position detection stage of BK ink cartridge has been omitted.

Take the M ink cartridge as an example, the facing position detection is executed when it is disposed at a position facing the light receiver, the printer transmits an instruction of M ON to control the LED thereon to emit light. At this time, all the ink cartridges receive the light emitting control instruction above, and according to the control rules described above, the control unit of each ink cartridge controls the LED thereof to emit light after being delayed 200 ms. Furthermore, according to the Table 2, it can be known that, since no other light emitting control instructions transmitted by the printer is received within 200 ms, the LEDs on the plurality of ink cartridges of the printer will all be lighted after 200 ms, and at this time, the light receiver receives the sufficient first light amount S1, and the first light amount S1 is greater than the preset threshold value of the printer. In following, the printer transmits the instruction of M OFF, and all the ink cartridges directly execute extinguishing action to the LED thereon according to the control rules after receiving the light emitting control instruction (M OFF). So far, the facing position detection of the M ink cartridge is completed. Subsequently, keeping the position of the M ink cartridge remain unchanged, the printer transmits the instruction of C ON to actuate the LED of the C ink cartridge adjacent to the M ink cartridge to emit light, so as to execute the adjacent position detection stage. The control units of the plurality of ink cartridges also delay 200 ms and then execute operation of light-on the LED. As described before, when in the adjacent position detection stage, the time interval between the light-on instruction and light-off instruction is relative short, while it can be known from the Table 2, the printer transmits an instruction of C OFF after 87.8 ms. At this time, since 87.8 ms<200 ms, the printer directly executes operation of stopping emitting light according to the control rules described above after receiving the instruction of C OFF. That is, the LEDs of all the ink cartridges are not illuminating, then, the received light amount of the light receiver in the printer side is 0, which is less than the first light amount S1. Thus, the printer considers that the M ink cartridge has been installed in the correct position, and can be used normally.

FIG. 9*a*-FIG. 9*c*, FIG. 10*a*-FIG. 10*c*, FIG. 11*a*-FIG. 11*c* and FIG. 12*a*-FIG. 12*c* are schematic diagrams showing the position detection process of a plurality of ink cartridges according to the embodiments of the present invention. Specifically, the installation detection process is systematically described according to FIG. 9*a*-FIG. 9*c*.

Figure 9A:
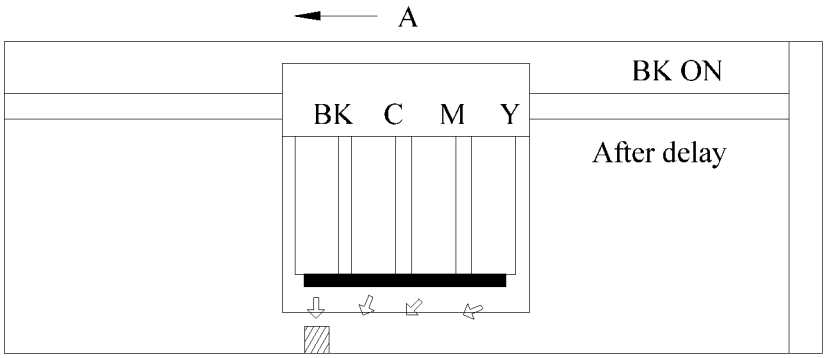
FIG. 9*a*-FIG. 9*c* are schematic diagrams showing a position detection process of a BK ink cartridge according to embodiments of the present invention.
Figure 9B:
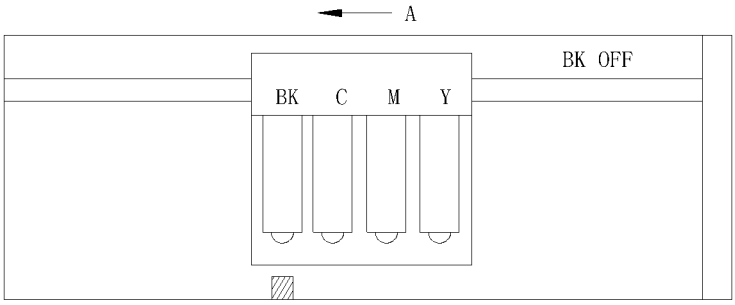

At first, the plurality of ink cartridges (BK/C/M/Y) is successively installed in the inkjet printer. Then, the carriage is driven by the printer motor to lead the plurality of ink cartridges thereon to move forth and back. The carriage stops moving when moving to a corresponding position that the BK ink cartridge is faced to the light receiver As shown in FIG. 9*a*, the control circuit of the printer transmits an instruction of BK ON for controlling the light emitting unit of the BK ink cartridge to emit light. Then, the control units of the four ink cartridges receive the light emitting control instruction via a common line, with acquiring that the light emitting control information is ON, and execute actuation operations to the LEDs to emit light thereon after being delayed 200 ms. That is, the LEDs of all the ink cartridges emit light. Further, as shown in FIG. 9*b*, the printer transmits an instruction of BK OFF for controlling the light emitting unit of the BK ink cartridge to be extinguished after the LED emits light for a while. The four ink cartridges directly turn off the LEDs thereof after receiving the light emitting control instruction BK OFF. At this time, the facing position detection stage of the BK ink cartridge has been finished, and the light receiver transmits the received light amount information to the control circuit of the printer, and marks the light amount as the first light amount S1, and the first light amount S1 is greater than the threshold preset by the printer.

Figure 9C:
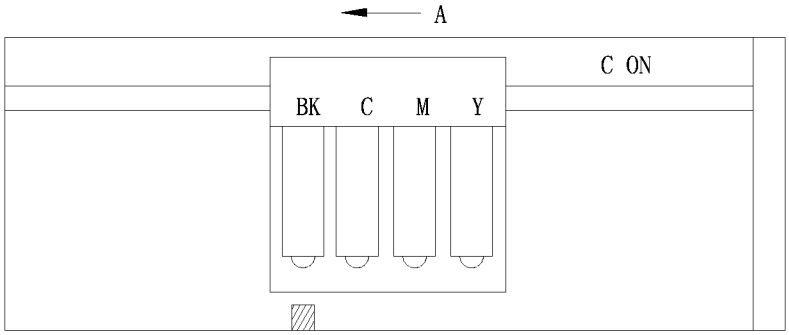

In subsequence, as shown in FIG. 9*c*, the BK ink cartridge position remains unchanged, the printer transmits light emitting control instruction C ON for controlling the light emitting unit of the C ink cartridge to emit light. The control units of the four ink cartridges execute operation of actuating the LED thereon to emit light after being delayed 200 ms. As described before, for the C ink cartridge, this stage includes the adjacent position detection and the facing position detection, and the adjacent position detection is prior to the facing position detection. Therefore, at this time, it is equivalent to that the LED is not illuminating during the adjacent position detection when delaying 200 ms. Then the control circuit of the printer considers that the second light amount S2 received by the BK ink cartridge adjacent light detection stage is 0, and less than the first light amount S1. As shown in FIG. 9*c*, it can be judged that the BK ink cartridge is installed correctly. So far, the adjacent position detection stage of the BK ink cartridge has been finished.

Figure 10A:
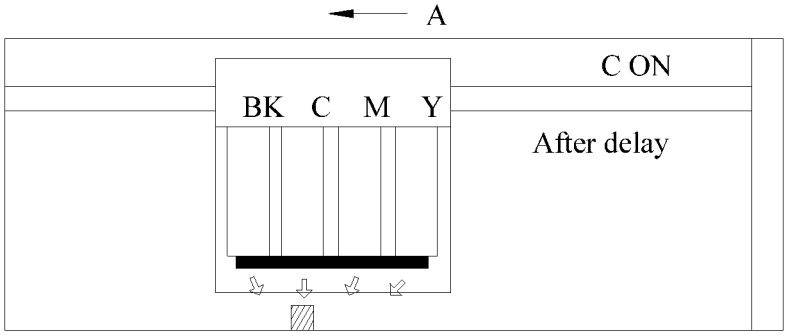
FIG. 10*a*-FIG. 10*c* are schematic diagrams showing a position detection process of a C ink cartridge according to embodiments of the present invention.
Figure 10B:
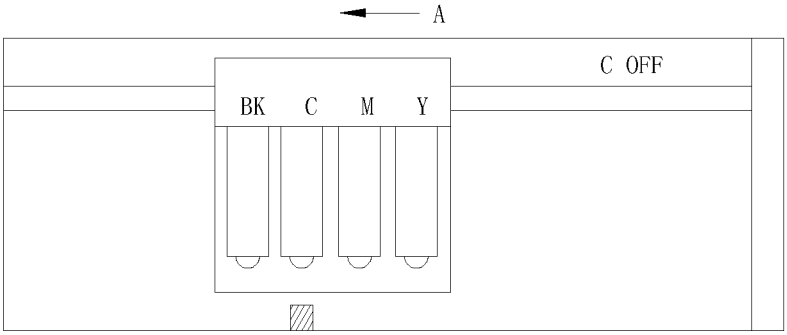
Figure 10C:
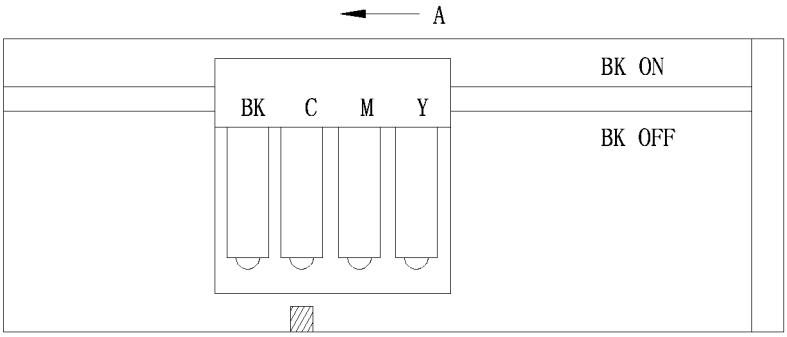

After finishing the adjacent position detection of BK ink cartridge, the printer moves the carriage to a place the C ink cartridge at a position corresponded to the light receiver, as shown in FIG. 10*a*, which is in a facing position detection stage of the C ink cartridge. At this time, due to the aforesaid "delay" control, a plurality of LEDs are all illuminated during moving process, so that when the C ink cartridge is facing the light receiver, the plurality of the above LEDs are all illuminated. Thus the light receiver may receive efficient light amount, that is, the third light amount S3 of the C ink cartridge. Subsequently, after the LED emitting light for a while, the printer transmits an instruction of C OFF for controlling the LED of the C ink cartridge to be extinguished. As shown in FIG. 10*b*, the four ink cartridges directly extinguish the LEDs thereon after receiving the above light emitting control instruction, at this time, the facing position detection stage of the C ink cartridge has been finished. As shown in FIG. 10*c*, keep the position of the C ink cartridge unchanged. The printer transmits a BK ON instruction to actuate the LED of the BK ink cartridge to be illuminated. Thus, the four ink cartridges all control the LEDs thereon to emit light after delaying 200 ms. However, after a time interval less than 100 ms, since the adjacent position detection stage of the C ink cartridge is over, the printer transmits a BK OFF instruction to extinguish the LED light of the BK ink cartridge, then at this time, the control unit of respective ink cartridge directly executes the BK OFF instruction after receiving it, without executing the original BK ON instruction. So that, the LED light is not illuminated, and the light receiver considers that the received fourth light amount S4 is 0, which is less than the third light amount S3. Then it is judged that the C ink cartridge is installed in the correct position.

Figure 11A:
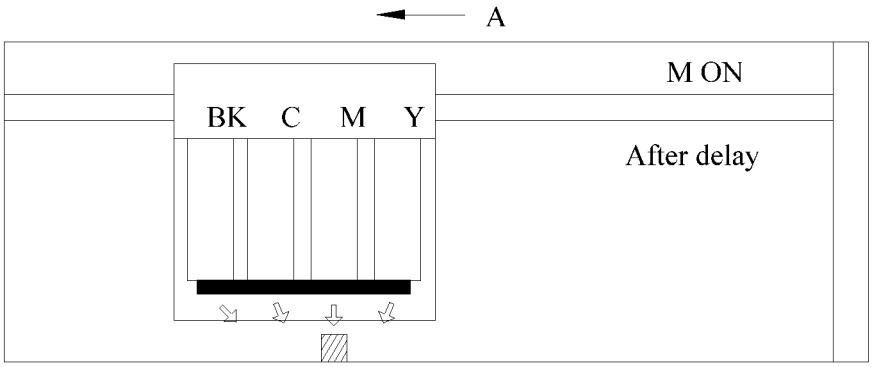
FIG. 11*a*-FIG. 11*c* are schematic diagrams showing a position detection process of a M ink cartridge according to embodiments of present invention.
Figure 11B:
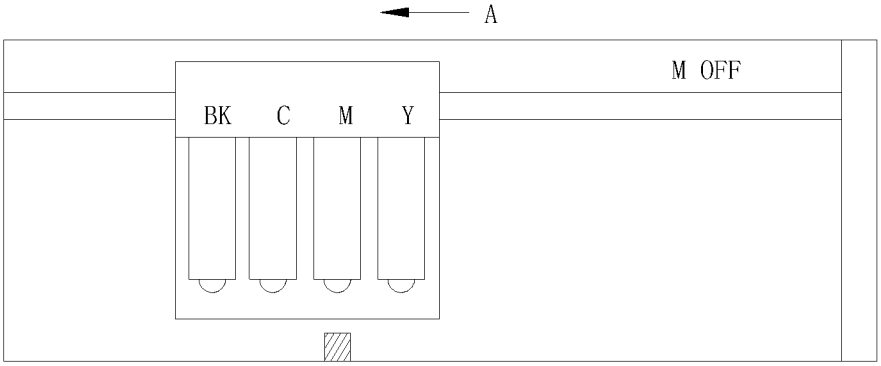
Figure 11C:
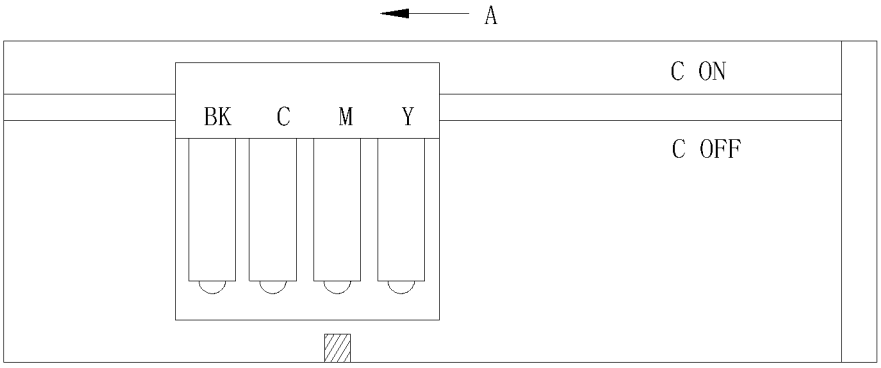

Then, entering the detection stage of the M ink cartridge. The printer moves the carriage to a position where the M ink cartridge corresponds to the light receiver, and successively transmits M ON and M OFF instructions to execute the facing position detection stage of the M ink cartridge, as shown in FIG. 11*a* and FIG. 11*b*. Then transmits C ON and C OFF instructions to execute the adjacent position detection stage of the M ink cartridge, as shown in FIG. 11*c*. The control manner of the light emitting unit is executed according to the aforesaid control rules. The printer control circuit judges whether the M ink cartridge is installed in the correct position according to the detected light amount comparison result.

Figure 12A:
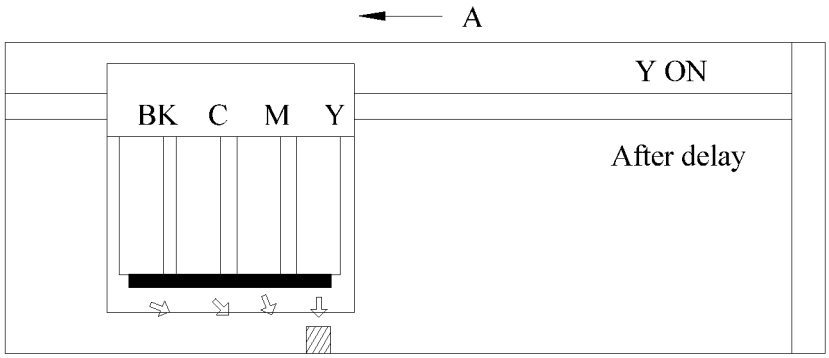
FIG. 12*a*-FIG. 12*c* are schematic diagrams showing a position detection process of a Y ink cartridge according to embodiments of the present invention.
Figure 12B:
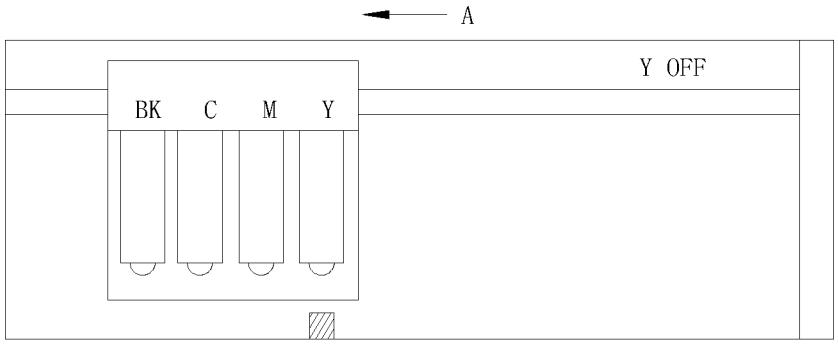
Figure 12C:
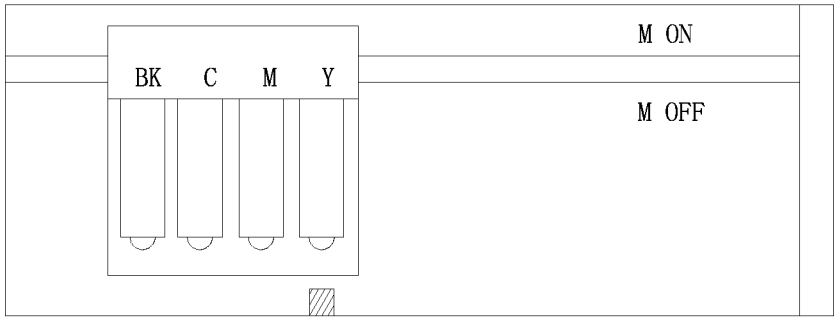

Finally entering into the detection of the Y ink cartridge. The printer moves the carriage to a place where the Y ink cartridge corresponds to the light receiver. Similarly, successively transmit Y ON and Y OFF instructions to execute the facing position detection stage of the Y ink cartridge. As shown in FIG. 12*a* and FIG. 12*b*. Then transmit M ON and M OFF instructions to execute the adjacent position detection stage to the Y ink cartridge, as shown in FIG. 12*c*. The control manner of the light emitting unit and the judgment rule of the printer control circuit are the same with the aforesaid.

Obviously, it can be seen from the above description, the solution of the present embodiment mainly adopts the manner of only executing the facing position detection and not executing the adjacent position detection to avoid detection error due to interference of external light during the ink cartridge detection. Furthermore, in order to guarantee that the ink cartridge with weaker light brightness of the light emitting unit can smoothly pass through the facing position detection stage, the light emitting unit is controlled by the control unit only according to the light emitting control information of the light emitting control instruction, so that the light emitting unit of the plurality of ink cartridges simultaneously emit light, thus the received light amount is sufficiently to insure the ink cartridge smoothly pass through the obligatory position detection mechanism preset in the printer and operated normally, when the light receiver executes the facing position detection, and also avoid source waste and appearance of the situation that "the ink cartridge cannot be used due to be considered as installed in a wrong position, even that the ink cartridge is installed in a correct position".

In summary, the solution of the embodiments of the present invention can efficiently guarantee the ink cartridge to smoothly pass through the installation position detection process preset by the printer, improve installation detection stability, increase compatibility of the imaging device to the ink cartridge, prevent appearance of the ink cartridge installation detection error caused by the manufacturing error of the LED light, provide selectivity for users, and decrease using cost for users.

Persons of ordinary skill in the art should understand that, in the above embodiments, since the imaging device is provided with a plurality of ink cartridges thereon, and the first time period and the second time period of the ink cartridges are respectively different, at this situation, the selected value of the "delay threshold (or called predetermined delay time t)" should be chosen as greater than the greatest second time period of the plurality of ink cartridges and less than the minimum first time period of the plurality of ink cartridges. Moreover, the "delay threshold value" of each ink cartridge may be set as the same or different, which is only needed to satisfy the value selection rule above. For example, as described in the above embodiments, the BK ink cartridge and the C ink cartridge can also be set as that actuating the light emitting unit to emit light in the BK ink cartridge being delayed 160 ms and in the C ink cartridge being delayed 205 ms, except actuating the light emitting unit thereon to emit light after delaying 200 ms. Because, 160 ms and 205 ms all belong to a range of (100 ms, 300 ms).

Persons of ordinary skill in the art may understand that, since the ink cartridge needs to be moved position during the facing position detection, and does not need to be moved position during the adjacent position detection. For this reason, a manner may also be adopted that the printer transmits light emitting control instruction before moving the ink cartridge to be detected to a position facing the light receiver, which could insure the time interval of the facing position detection greater than the time interval of the adjacent position detection to guarantee the solution of the above embodiments to be executed smoothly.

For the case of distinguishing the first determined ink cartridge and the second determined ink cartridge, in order to describe the light emitting control process in detail, the following provides another application example for explanation.

As shown in FIG. 7, the inkjet printer can be provided with four ink cartridges classified in colors, that is, BK ink cartridge, C ink cartridge, M ink cartridge, and Y ink cartridge. Since the Y ink cartridge is disposed in the final position in the moving direction of the carriage, it could be not as an adjacent ink cartridge to provide adjacent position detection for the other ink cartridges. So, the time period for the Y ink cartridge to emit light is relative short. Thus, the Y ink cartridge is considered as the second determined ink cartridge, and the BK ink cartridge, C ink cartridge, and M ink cartridge are considered as the first determined ink cartridges.

First, the circuit board receives the light emitting control instruction transmitted from the printer via the interface unit. Then, the control unit reads and identifies the light emitting control instruction. The light emitting control instruction generally includes ink cartridge identifying information and codes for indicating illuminating or extinguishing of the light emitting unit.

Then, execute corresponding operations according to the different judgment results.

When identifying that the light emitting control instruction is the a light-on instruction of the second determined ink cartridge, which including the ink cartridge identifying information of the Y ink cartridge and codes of illuminating the light emitting unit, the control unit turns on the light emitting unit, or starts the second light-on delay timing and turns on the light emitting unit when the timing is over.

When identifying that the light emitting control instruction is a light-off instruction of the second determined ink cartridge, which including the ink cartridge identifying information of the Y ink cartridge and including codes of turning off the light emitting unit, the control unit controls to turn off the light emitting unit, that is, executing operation of "extinguishing".

When identifying the light emitting control instruction is the light-off instruction of the first determined ink cartridge, which not including the ink cartridge identifying information of the Y ink cartridge but including codes of closing the light emitting unit, the control unit controls to close the light emitting unit, that is, executing operation of "extinguishing".

When identifying that the light emitting control instruction is a light-on instruction of the first determined ink cartridge, which not including the ink cartridge identifying information of the Y ink cartridge and including codes of turning on the light emitting unit, the control unit controls the time delay unit to start the first light-on delay timing. During the timing, if the interface unit receives a new light emitting control instruction, then stop the timing, and execute operation according to the information included in the new light emitting control instruction. If a new light emitting control instruction is not received during the timing, control to turn on the light emitting unit when the time is over.

The light-on delay timing can be carried out by a specific delay circuit or a computer program. This is common sense of the person skilled in the art, which is not described here in detail.

Persons of ordinary skill in the art may understand that, the interface unit may adopt the manner of wireless connection except for adopting the mentioned manner of cable connection such as electrical contact etc. in the above embodiments.

Persons of ordinary skill in the art may understand that, the light emitting unit in the above embodiments can be disposed at a position facing the light receiver, and also can be disposed at a deviation position with conducting light to the light receiver via optical conducting components.

Figure 13:
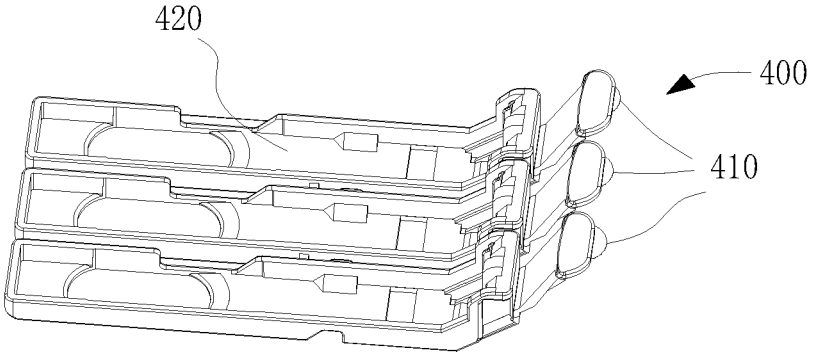
FIG. 13 is a schematic structural diagram of a adapter according to a varied embodiment of the present invention.

Persons of ordinary skill in the art may understand that, in the above embodiments, a manner that a single control unit controlling a plurality of light emitting units also can be used. Specifically, as shown in FIG. 13, the control unit and a plurality of light emitting units 410 may be disposed on an adaptor 400, and the adaptor 400 with a space 420 for accommodating a plurality of ink cartridges is disposed between the aforesaid ink cartridges and the main body of the imaging device. That is, the adaptor 400 is mounted on the main body of the imaging device first, and then the plurality of ink cartridges is mounted on the adaptor 400. At this time, each light emitting unit 410 is corresponded to the mounted ink cartridges one by one. Thus, there is no need for the ink cartridges to be provided with a control unit and a light emitting unit. It is only needed to provide a storage unit for storing relevant information of the ink cartridge, so as to perform data transmission and reading/writing operation with the main body of the imaging device. In addition, persons of ordinary skill in the art may understand that, in the above embodiments, the plurality of light emitting units is respectively disposed on the plurality of ink cartridges. At this time, the control unit disposed on the adaptor only needs to be connected with the plurality of ink cartridges via the interface units, thus controlling the light emitting unit according to the light emitting control instruction transmitted by the main body of the imaging device.

Figure 14:
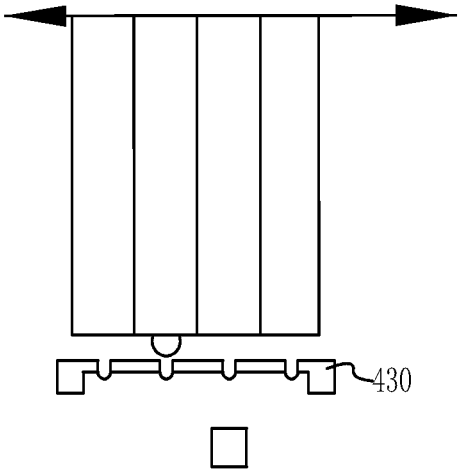
FIG. 14 is a schematic structural diagram of a light transmitter according to a varied embodiment of the present invention.

Persons of ordinary skill in the art may understand that, in the above embodiments, in the plurality of ink cartridges mounted on the main body of the imaging device, only one ink cartridge is provided with the control unit and the light emitting unit, and other ink cartridges do not need those. Then at this time, a light transmitter 430 can be provided to conduct light to a position where the each ink cartridge corresponds to the light receiver when the light emitting unit emits light, as shown in FIG. 14.

Persons of ordinary skill in the art may understand that, in the above embodiments, when receiving the light-on instruction, the ink cartridge to be detected starts a light-on delay timing and controls to emit light after delaying a preset time. If the delay time is not over, and a next light-on instruction is received, at this time, the light-on delay timing started by the previous light-on instruction is stopped, and is cleared or reset, then begins to execute a timing of the next light-on instruction.

Persons of ordinary skill in the art may understand that, in the above embodiments, the first time period of a plurality of the imaging devices is different from each other, and the second time period also different from each other. The time delay threshold value of each ink cartridge may be set as different value according to the respective first time period and second time period. For example, if the first time period and the second time period of the BK ink cartridge respectively is 400 ms and 100 ms, the time delay threshold value may be set as 200 ms, and the first time period and the second time period of the C INK CARTRIDGE respectively is 200 ms and 40 ms, at this time, the time delay threshold value thereof may be set as 80 ms. Specifically, the control unit of the individual ink cartridge pre-stores a plurality of time delay threshold values. Each time delay threshold value corresponds to each light-on instruction transmitted by the main body of the imaging device during the position detection process, and at this time, the light emitting control instructions transmitted by the main body of the imaging device are transmitted one by one according to preset order. The control unit is also provided with a counting module to count the times of the received light-on instructions, and set different rules for the light-on instructions for different ink cartridges. For example, when respectively executing the facing position detection and the adjacent position detection to the BK ink cartridge and the C ink cartridge, the main body of the imaging device will successively transmit BK ON-BK OFF (BK ink cartridge facing position detection)-C ON-C OFF (BK ink cartridge adjacent position detection)-C ON-C OFF (C ink cartridge facing position detection)-BK ON-BK OFF (C ink cartridge adjacent position detection). At this time, the control units in the BK ink cartridge and the C ink cartridge pre-store the first delay threshold value (refer to BK ink cartridge, 200 ms) and the second delay threshold value (refer to C ink cartridge, 80 ms), and set a rule. If detecting that times of appearance of the light-on instruction of the BK or C ink cartridge is equal to 1, the first delay threshold value is used; if the times of appearance is greater than 1, the second delay threshold value is used. When a plurality of ink cartridges are provided, the aforesaid manner can be deduced by this analogy.

Persons of ordinary skill in the art may understand that, all or a part of the steps of the foregoing method embodiments may be implemented by a program instructing relevant hardware. The foregoing program may be stored in a computer readable storage medium. When executing the program, the steps including the aforesaid method embodiments are executed. And the aforesaid storage media includes all kinds of mediums capable of storing program codes, such as a ROM, a RAM, a magnetic disk, and an optical disc etc.

Finally, it should be noted that, the foregoing embodiments are merely used for illustrating solutions of the present invention, and cannot be used to limit the present invention. Although the present invention is described in detail by reference to the aforesaid embodiments, persons of ordinary skilled in the art should understand that, modifications made to the solutions described in the aforesaid embodiments, or equivalent changes made to a part of or all of the technical features thereof are allowed, and the modifications or the equivalent changes will not render the essence of the solutions to depart from the scope of the present embodiments.

What is claimed is:

1. A method for controlling light emission of an ink cartridge, wherein the ink cartridge is detachably mounted on a main body of an imaging device, and the ink cartridge comprises an interface unit used for receiving signal transmitted by the main body of the imaging device, a storage unit used for storing relevant information of the ink cartridge, a light emitting unit for emitting light to a light receiving unit disposed on the main body of the imaging device, and a control unit for controlling the light emitting unit to emit light, and at least two ink cartridges arranged on the main body of the imaging device, the method comprises:

receiving and identifying, by the control unit, a light emitting control instruction from the main body of the imaging device;

starting, by the control unit, a light-on delay timing when identifying that the light emitting control instruction is a light-on instruction;

controlling, by the control unit, the light emitting unit of the ink cartridge to stop emitting light when identifying that the light emitting control instruction is a light-off instruction;

controlling, by the control unit, the light emitting unit to emit light when detecting that a timing value of the light-on delay timing reaches a delay threshold value;

wherein, the delay threshold value is greater than an adjacent detection time period, which is a time interval for an adjacent position detection of the ink cartridge to be detected by the main body of the imaging device, and is less than a facing detection time period, which is a time interval for a facing position detection of the ink cartridge to be detected by the main body of the imaging device.

2. The method according to claim 1, wherein, more specifically, the receiving and identifying, by the control unit, the light emitting control instruction from the main body of the imaging device comprises: receiving, by the control unit, the light emitting control instruction from the main body, and identifying a control object and control content of the light emitting control instruction;

more specially, the starting, by the control unit, the light-on delay timing when identifying that the light emitting control instruction is a light-on instruction comprises: starting, by the control unit, a first light-on delay timing when identifying that the light emitting control instruction is a light-on instruction for a first predetermined ink cartridge; and/or, starting, by the control unit, a second light-on delay timing or controlling the light emitting unit to emit light when identifying that the light emitting control instruction is a light-on instruction for a second predetermined ink cartridge;

more specially, the controlling, by the control unit, the light emitting unit to emit light when detecting that a timing value of the light-on delay timing reaches a delay threshold value comprises: controlling, by the control unit, the light emitting unit to emit light when detecting that a timing value of the first light-on delay timing reaches a first delay threshold value; and/or, controlling, by the control unit, the light emitting unit to emit light when detecting that a timing value of the second light-on delay timing reaches a second delay threshold value;

wherein, the first delay threshold value is greater than the second time period, which is the adjacent detection time period of the first determined ink cartridge, and is less than the first time period, which is the facing detection time period of the first determined ink cartridge;

wherein, the second delay threshold value is less than the third time period, which is the facing detection time period of the second determined ink cartridge.

3. The method according to claim 1, wherein the method further comprises:

stopping, by the control unit, the light-on delay timing, and/or resetting the light-on delay timing when identifying that the light emitting control instruction is a light-off instruction.

4. The method according to claim 3, wherein the receiving and identifying, by the control unit, the light emitting control instruction from the main body of the imaging device comprises:

receiving, by the control unit, the light emitting control instruction that comprises ink cartridge identifying information and light control information from the main body of the imaging device;

according to the ink cartridge identifying information, determining, by the control unit, the ink cartridge identifying information of at least two ink cartridges as the ink cartridge identifying information of the ink cartridge in which the control unit is located, and determining the light emitting control instruction as a light emitting control instruction of the ink cartridge in which the control unit is located;

according to the light control information, determining, by the control unit, the light emitting control instruction is a light-on instruction or a light-off instruction.

5. The method according to claim 4, wherein the ink cartridge identifying information comprises at least two bits of logic value, more specially, the determining, by the control unit, the ink cartridge identifying information of at least two ink cartridges as the ink cartridge identifying information of the ink cartridge in which the control unit is located, comprises:

abandoning, by the control unit, a part bits of or all bits of the logic value of the ink cartridge identifying information;

determining, by the control unit, that the received ink cartridge identifying information is the ink cartridge identifying information of the ink cartridge in which the control unit is located, according to the remaining bits of the logic value of the ink cartridge identifying information and corresponding bits of logic value of the identifying information of the ink cartridge in which the control unit is located.

6. A control unit for controlling light emission of an ink cartridge, wherein the control unit is disposed on an ink cartridge which is detachably installed in a main body of an imaging device, and the main body of the imaging device has a light receiver, the ink cartridge comprises an interface unit for receiving signal transmitted from the main body of the imaging device, a storage unit for storing relevant information of the ink cartridge, and a light emitting unit for emitting light to the light receiver disposed on the main body of the imaging device, and at least two ink cartridges are provided on the main body of the imaging device, wherein, the control unit comprises:

an instruction identifying module, configured to receive and identify a light emitting control instruction from the main body of the imaging device;

a light-on delay module, configured to start a light-on delay timing when identifying that the light emitting control instruction is a light-on instruction;

an extinguishing module, configured to control the light emitting unit on the ink cartridge to stop emitting light when identifying that the light emitting control instruction is a light-off instruction;

an illuminating module, configured to control the light emitting unit on the ink cartridge to emit light when detecting that a timing value of the light-on delay timing reaches a delay threshold value;

wherein, the delay threshold value is greater than an adjacent detection time period, which is a time interval for an adjacent position detection of the ink cartridge to be detected by the main body of the imaging device, and is less than a facing detection time period, which is a time interval for a facing position detection of the ink cartridge to be detected by the main body of the imaging device.

7. The control unit according to claim 6, wherein, the instruction identifying module is configured to receive a light emitting control instruction from the main body of the imaging device, and identify control object and control content of the light emitting control instruction;

the light-on delay module comprises:

a first light-on delay module, configured to start a first light-on delay timing when identifying that the light emitting control instruction is a light-on instruction for a first determined ink cartridge;

a second light-on delay module, configured to start a second light-on delay timing or control the light emitting unit to emit light, when identifying that the light emitting control instruction is a light-on instruction for a second determined ink cartridge;

the illuminating module comprises:

a first illuminating module, configured to control the light emitting unit on the ink cartridge to emit light when detecting that a timing value of the first light-on delay timing reaches a first delay threshold value;

a second illuminating module, configured to control the light emitting unit to emit light when detecting that a timing value of the second light-on delay timing reaches a second delay threshold value;

wherein, the first delay threshold value is greater than a second time period, which is the adjacent detection time period of the first determined ink cartridge, and is less than the first time period, which is the facing detection time period of the first determined ink cartridge;

wherein, the second delay threshold value is less than the third time period, which is the facing detection time period of the second determined ink cartridge.

8. The control unit according to claim 6, wherein the control unit further comprises:

a timing control module, configured to stop the light-on delay timing and/or reset the light-on delay timing when the control unit identifies that the light emitting control instruction is a light-off instruction.

9. The control unit according to claim 8, wherein the instruction identifying module comprises:

an instruction receiving unit, configured to receive the light emitting control instruction that comprises ink cartridge identifying information and light control information from the main body of the imaging device;

an ink cartridge determining unit, configured to determine that the ink cartridge identifying information of at least two ink cartridges as the ink cartridge identifying information of the ink cartridge in which the control unit is located, according to the ink cartridge identifying information, and determine the light emitting control instruction as a light emitting control instruction of the ink cartridge in which the control unit is located, according to a determining result of the ink cartridge identifying information;

a light control unit, configured to determine whether the instruction is a light-on instruction or a light-off instruction according to the light control information.

10. The control unit according to claim 9, wherein the ink cartridge identifying information comprises at least two bits of logic value, the ink cartridge determining unit comprises:

a logic value abandoning subunit, configured to abandon a part bits of or all bits of the logic value of the ink cartridge identifying information;

a remaining value comparing subunit, configured to determine that the received ink cartridge identifying information is the ink cartridge identifying information of the ink cartridge in which the control unit is located, according to the remaining bits of logic value of the ink cartridge identifying information and corresponding bits of logic value of the identifying information of the ink cartridge in which the control unit is located;

an instruction determining subunit, configured to determine that the light emitting control instruction is the a light emitting control instruction of the ink cartridge in which the control unit is located according to a determining result of the ink cartridge identifying information.

11. The control unit according to claim 10, wherein the electrically connection between the logic value abandoning subunit and electrical contacts, which is arranged on the ink cartridge in which the control unit is located and used for receiving each bit of the logic value, is turned on or cut off by shifting a switch.

12. An circuit board for controlling light emission of an ink cartridge, comprising an interface unit configured to receive signal transmitted by a main body of an imaging device, a storage unit configured to store relevant information of the ink cartridge, and a control unit, wherein, the interface unit and the storage unit are respectively connected to the control unit, and the control unit is the control unit according to claim 6.

13. The circuit board according to claim 12, wherein the interface unit is electrical contacts configured to receive high level voltage or low level voltage transmitted by the main body of the imaging device to form an instruction which includes at least two bits of logic value.

14. The circuit board according to claim 13, wherein the circuit board further comprises: a light emitting unit disposed on the circuit board which emits light to a light receiver of the main body of the imaging device, and is connected to the control unit.

15. An ink cartridge, comprising a main body of an ink cartridge and the circuit board according to claim 12.

16. The ink cartridge according to claim 15, wherein the ink cartridge further comprises a light emitting unit connected to the control unit, which emits light to the light receiver of the main body of the imaging device, wherein the light emitting unit is disposed on the circuit board or on the main body of the ink cartridge.

17. An imaging device, comprising a main body of an imaging device and at least two ink cartridges, wherein the main body of the imaging device comprises at least a light receiver, a carriage movable related to the light receiver and the at least two ink cartridges mounting fixedly thereon, and a position detection module, wherein the ink cartridges are the ink cartridges according to claim 15;

the interface unit of each ink cartridge is connected to an instruction output terminal of the main body of the imaging device via a common line;

the position detection module comprises:

a moving control unit, configured to control the carriage to move to a position where an ink cartridge to be detected is facing the light receiver;

a light emitting control unit, configured to control the light emitting unit of the ink cartridge to emit light in a facing detection time period of facing position detection and an adjacent detection time period of an adjacent position detection of the ink cartridge to be detected by transmitting light emitting control instructions to the ink cartridge; and a light amount detection unit, configured to determine that the ink cartridge to be detected is mounted on the correct position, when identifying that a first light amount received in the facing detection time period is greater than a first preset light amount, and a second light amount received in the adjacent detection time period is less than the first light amount, or when identifying that a third light amount received in the facing detection time period is greater than a third preset light amount.

18. The imaging device according to claim 17, more specifically, wherein the light amount detection unit is configured to determine that the ink cartridge to be detected is mounted on the correct position, when identifying that the first light amount received in the facing detection time period is greater than the first preset light amount, and the second light amount received in the adjacent detection time period is less than the first light amount and a second preset light amount.

19. The imaging device according to claim 18, wherein the corresponding facing detection time period and the corresponding adjacent detection time period for each ink cartridge are different from other ink cartridges, when different ink cartridges are taken as the ink cartridge to be detected, wherein a delay threshold value configured for each control unit of any ink cartridge is greater than the greatest adjacent detection time period in the imaging device, and less than the minimum facing detection time period.

20. The imaging device according to claim 19, wherein the delay threshold values configured for different control units of different ink cartridges are identical with each other or different from each other.

* * * * *